US011269269B2

(12) United States Patent
Sato

(10) Patent No.: US 11,269,269 B2
(45) Date of Patent: Mar. 8, 2022

(54) PROCESS UNIT

(71) Applicant: Brother Kogyo Kabushiki Kaisha, Nagoya (JP)

(72) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/096,251

(22) Filed: Nov. 12, 2020

(65) Prior Publication Data

US 2021/0063913 A1 Mar. 4, 2021

Related U.S. Application Data

(63) Continuation of application No. 16/683,851, filed on Nov. 14, 2019, now Pat. No. 10,866,538, which is a (Continued)

(30) Foreign Application Priority Data

Aug. 13, 2013 (JP) ..... 2013-168352

(51) Int. Cl.
*G03G 21/16* (2006.01)
*G03G 15/08* (2006.01)
(Continued)

(52) U.S. Cl.
CPC ..... *G03G 15/0889* (2013.01); *G03G 21/105* (2013.01); *G03G 21/12* (2013.01)

(58) Field of Classification Search
CPC .. G03G 15/0889; G03G 21/10; G03G 21/105; G03G 21/12; G03G 21/1814
(Continued)

(56) References Cited

U.S. PATENT DOCUMENTS 5,204,713 A 4/1993 Yamamura
5,341,200 A 8/1994 Thomas
(Continued)

FOREIGN PATENT DOCUMENTS

JP 2003-066815 A 3/2003
JP 2008-122925 A 5/2008

OTHER PUBLICATIONS

Jun. 27, 2019—U.S. Non-final Office Action—U.S. Appl. No. 16/256,088.

(Continued)

*Primary Examiner* — Hoan H Tran
(74) *Attorney, Agent, or Firm* — Banner & Witcoff, Ltd.

(57) ABSTRACT

A process unit has an image carrying unit having an image carrying member configured to be rotatable about a first axis extending in a first direction, and a developing agent removing member, a developing unit having a developing agent carrying member configured to be rotatable about a second axis parallel to the first axis, and a waste developing agent collecting unit configured to collect the developing agent removed by the removing member from the image carrying member. The waste developing agent collecting unit is arranged on one side in the first direction with respect to the developing unit such that the waste developing agent collecting unit faces the developing unit, and the developing unit is connected to the waste developing agent collecting unit such that the developing unit being movable in a second direction which is perpendicular to the first direction with respect to the waste developing agent collecting unit.

8 Claims, 15 Drawing Sheets

Related U.S. Application Data continuation of application No. 16/283,983, filed on Feb. 25, 2019, now Pat. No. 10,503,099, which is a continuation of application No. 16/058,420, filed on Aug. 8, 2018, now Pat. No. 10,241,442, which is a continuation of application No. 15/818,055, filed on Nov. 20, 2017, now Pat. No. 10,061,229, which is a continuation of application No. 15/691,076, filed on Aug. 30, 2017, now Pat. No. 10,197,945, which is a continuation of application No. 15/075,398, filed on Mar. 21, 2016, now Pat. No. 9,753,406, which is a continuation of application No. 14/816,371, filed on Aug. 3, 2015, now Pat. No. 9,291,986, which is a continuation of application No. 14/456,047, filed on Aug. 11, 2014, now Pat. No. 9,098,050.

(51) Int. Cl.
*G03G 21/10* (2006.01)
*G03G 21/12* (2006.01)

(58) Field of Classification Search
USPC ..... 399/107, 110, 111, 358
See application file for complete search history.

(56) References Cited

U.S. PATENT DOCUMENTS 6,044,241 A 3/2000 Kumar et al.
6,314,250 B1 11/2001 Miyashiro
6,377,765 B1 4/2002 Shishido et al.
6,728,500 B2 4/2004 Naito et al.
6,754,458 B2 6/2004 Makihira
6,975,830 B2 * 12/2005 Murakami ..... G03G 21/12 399/358
7,366,455 B2 4/2008 Iwasaki et al.
7,369,792 B2 5/2008 Shiraki
7,395,008 B2 7/2008 Sato et al.
7,486,910 B2 * 2/2009 Kitozaki ..... G03G 15/0865 399/111
7,890,044 B2 2/2011 Shimizu et al.
7,899,355 B2 3/2011 Sakuma
8,131,182 B2 3/2012 Mizuno et al.
8,135,329 B2 3/2012 Shimizu et al.
8,238,783 B2 8/2012 Yamazaki
8,422,893 B2 4/2013 Kim et al.
8,509,650 B2 8/2013 Kikuchi et al.
9,588,480 B2 3/2017 Fukuchi et al.
2003/0039484 A1 2/2003 Naito et al.
2005/0063734 A1 3/2005 Saito et al.
2007/0154236 A1 7/2007 Kwon
2008/0095559 A1 4/2008 Shimizu et al.
2011/0182615 A1 7/2011 Morishita
2012/0039626 A1 2/2012 Kim et al.
2012/0195627 A1 8/2012 Kikuchi

OTHER PUBLICATIONS

Nov. 14, 2019—U.S. Notice of Allowance—U.S. Appl. No. 16/256,088.

* cited by examiner

UP
FRONT
REAR
DOWN
50
146
51R(51)
18
81
55
80
45
20
64a
64
64b
64c
65
65a
65b
65c
53
54

50
51L(51)
52
18
94
88
98
90
99
93
63
46
50
53
54

50
52
56
18
81
22
55
80
90
84
83
87
20
45
46
N
77
85a
85
86a
86
86b
86c
72
69
71
70
85b
85c
63
53
68
53
54

PROCESS UNIT

CROSS-REFERENCE TO RELATED APPLICATION

This application is a continuation of U.S. patent application Ser. No. 16/683,851 filed Nov. 14, 2019, which is a continuation of U.S. patent application Ser. No. 16/283,983 filed Feb. 25, 2019, issued as U.S. Pat. No. 10,503,099, which is a continuation of U.S. patent application Ser. No. 16/058,420 filed Aug. 8, 2018, issued as U.S. Pat. No. 10,241,442 on Mar. 26, 2019, which is a continuation of U.S. patent application Ser. No. 15/818,055 filed Nov. 20, 2017, issued as U.S. Pat. No. 10,061,229, which is a continuation of U.S. patent application Ser. No. 15/691,076 filed Aug. 30, 2017, issued as U.S. Pat. No. 10,197,945 on Feb. 5, 2019, which is a continuation of U.S. patent application Ser. No. 15/075,398 filed Mar. 21, 2016, issued as U.S. Pat. No. 9,753,406 on Sep. 5, 2017, which is a continuation of U.S. patent application Ser. No. 14/816,371 filed Aug. 3, 2015, issued as U.S. Pat. No. 9,291,986 on Mar. 22, 2016, which is a continuation of U.S. patent application Ser. No. 14/456,047 filed Aug. 11, 2014, issued as U.S. Pat. No. 9,098,050 on Aug. 4, 2015, which claims priority under 35 U.S.C. § 119 from Japanese Patent Applications No. 2013-168352 filed on Aug. 13, 2013. The entire subject matter of the above applications is incorporated herein by reference.

BACKGROUND

Technical Field

The present disclosure relates to a process unit which is used in an image forming apparatus configured to form an image in accordance with an electrophotographic image forming method.

Conventional Art

Conventionally, an electrophotographic image forming apparatus has been known. Typically, such an apparatus has an image carrying member on which an electrostatic latent image is formed, a developing unit supplying toner to the image carrying member, a cleaning device having a cleaning blade configured to remove the toner remained on the image carrying member. Typically, such an apparatus further includes a toner conveying screw configured to convey the toner removed from the image carrying member (i.e., the waste toner) in a horizontally outward direction, a toner conveying belt configured to convey the waste toner upward, and another toner conveying device having a toner collecting screw configured to convey the waste toner in a horizontally inward direction, and a toner collection device which is arranged at an upper end of the developing unit and collects the waste toner conveyed by the waste toner collecting screw.

SUMMARY

In the image forming apparatus configured as above, the waste toner is scraped from the image carrying member with the cleaning blade. The scraped waste toner is conveyed horizontally with the toner conveying screw, upward with a toner conveying belt, and further horizontally with the toner collecting screw, and then collected by the waste toner collecting device arranged at the top of the developing device.

In the conventional image forming apparatus as described above, the waste toner is once conveyed horizontally, then upward and further conveyed horizontally. Therefore, the conveying unit has a complicated structure. Further, due to such a complicated structure, the toner conveying unit may be upsized, which makes it difficult to reduce an entire size of a process unit.

According to aspects of the disclosure, there is provided a process unit, which has an image carrying unit having an image carrying member configured to be rotatable about a first axis extending in a first direction, and a removing member configured to remove developing agent remained on the image carrying member, a developing unit configured to reserve the developing agent, the developing unit having a developing agent carrying member configured to be rotatable about a second axis which is parallel to the first axis, and a waste developing agent collecting unit configured to collect the developing agent removed by the removing member from the image carrying member. The waste developing agent collecting unit is arranged on one side in the first direction with respect to the developing unit such that the waste developing agent collecting unit faces the developing unit, and the developing unit is connected to the waste developing agent collecting unit such that the developing unit being movable in a second direction which is perpendicular to the first direction with respect to the waste developing agent collecting unit.

According to aspects of the disclosure, there is provided a process unit to be used in an image forming apparatus configured to form an image in accordance with an electrophotographic image forming method, which has an image carrying unit having a photoconductive drum configured to be rotatable about a first axis extending in a first direction, and a toner removing member configured to remove toner remained on the photoconductive drum, a developing unit configured to reserve the toner, the developing unit having a developing roller configured to be rotatable about a second axis which is parallel to the first axis, and a waste toner collecting unit configured to collect the toner removed by the toner removing member from the photoconductive drum. The waste toner collecting unit is arranged on one side in the first direction with respect to the developing unit such that the waste toner collecting unit faces the developing unit, and the developing unit is connected to the waste toner collecting unit such that the developing unit being movable in a second direction which is perpendicular to the first direction with respect to the waste toner collecting unit.

BRIEF DESCRIPTION OF THE ACCOMPANYING DRAWINGS

FIG. 1 schematically shows a cross-sectional side view of a process cartridge according to an illustrative embodiment of the disclosure.

Figure 4:
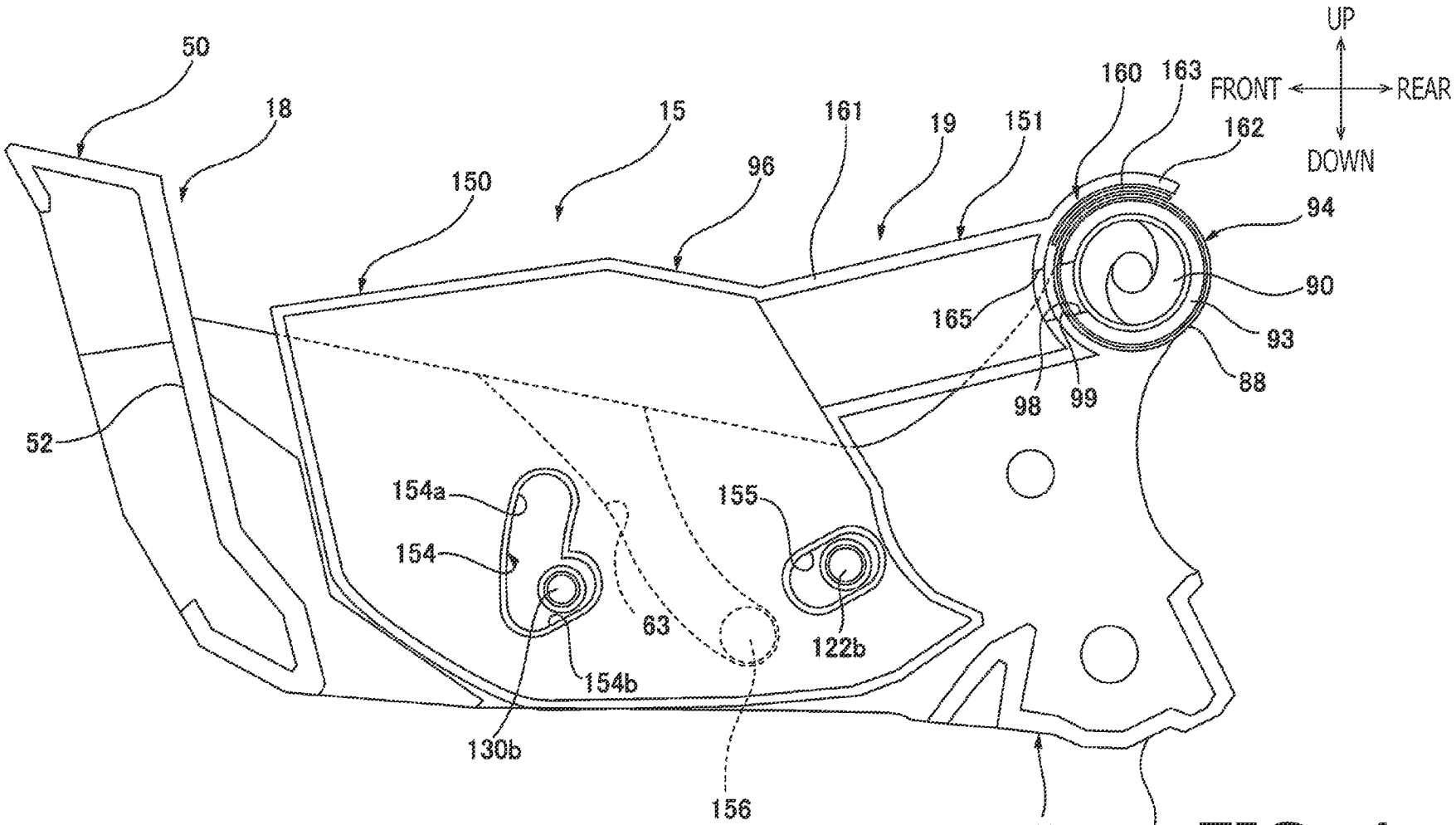
FIG. 4 is a cross-sectional side view of the process cartridge taken along line A-A of FIG. 3.
Figure 8:
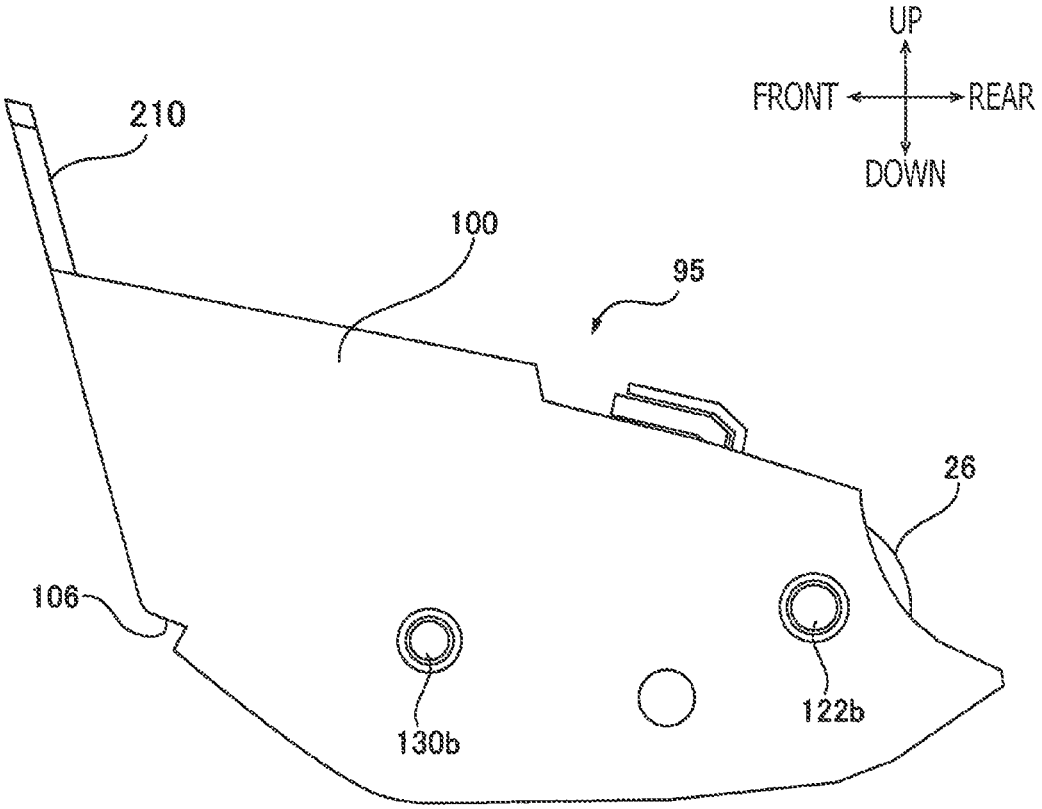

FIG. 8 schematically shows a side view of the drum cartridge shown in FIG. 4 viewed from right.

Figure 5:
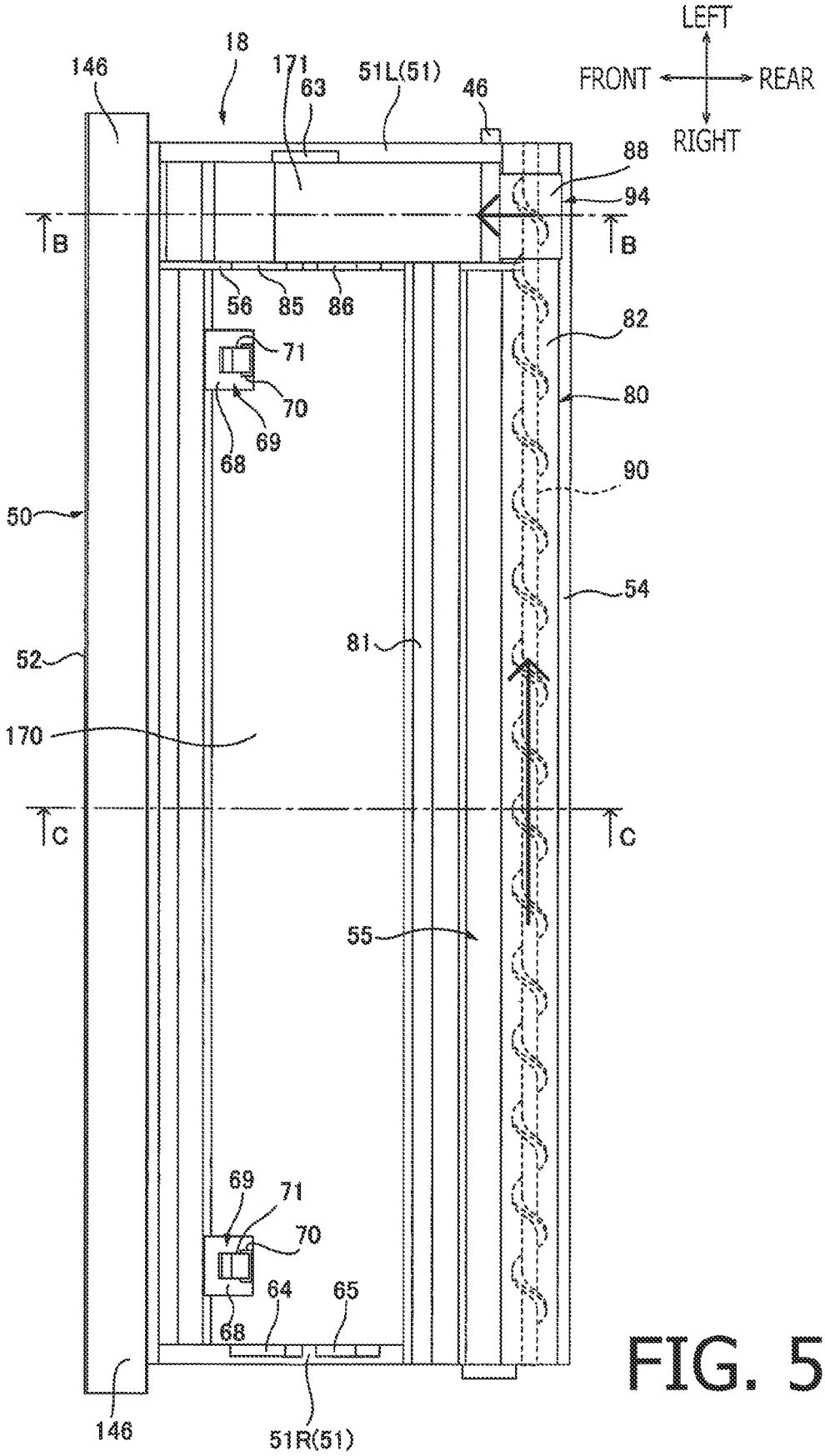
FIG. 5 is a plan view of a drum cartridge shown in FIG. 1.
Figure 9:
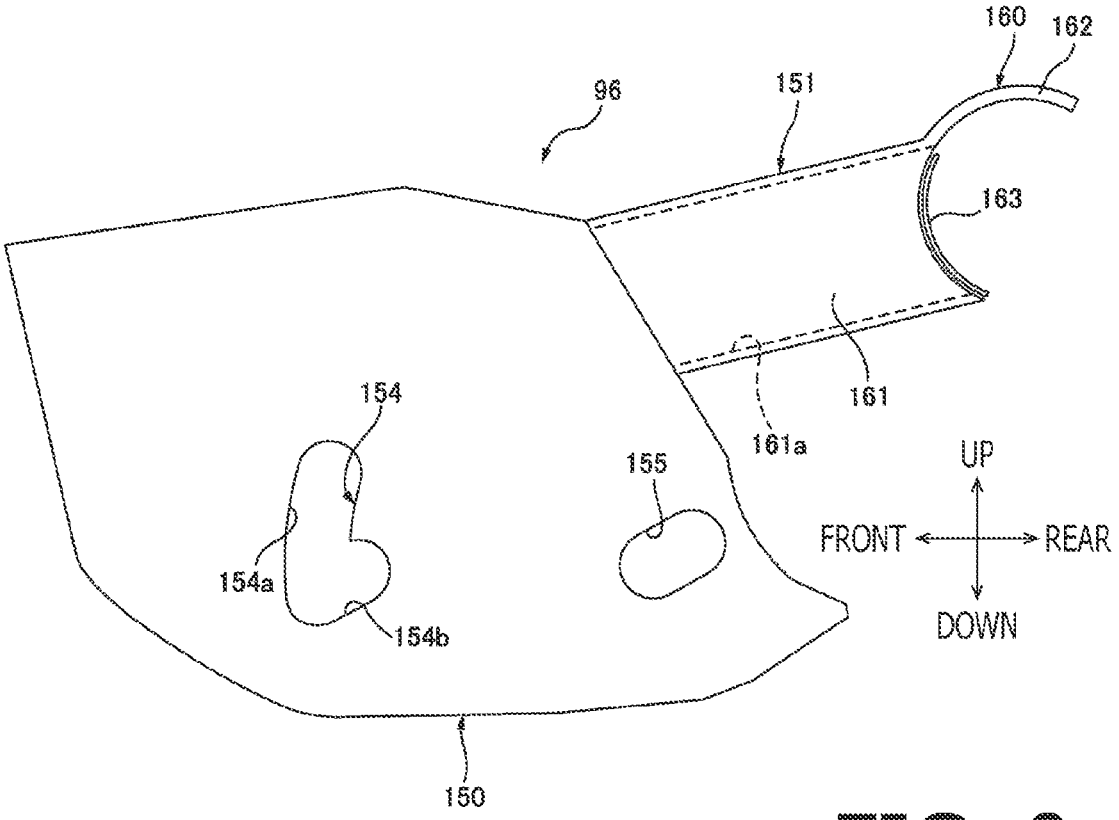

FIG. 9 schematically shows a side view of a waste toner collection box shown in FIG. 5 viewed from right.

Figure 10A:
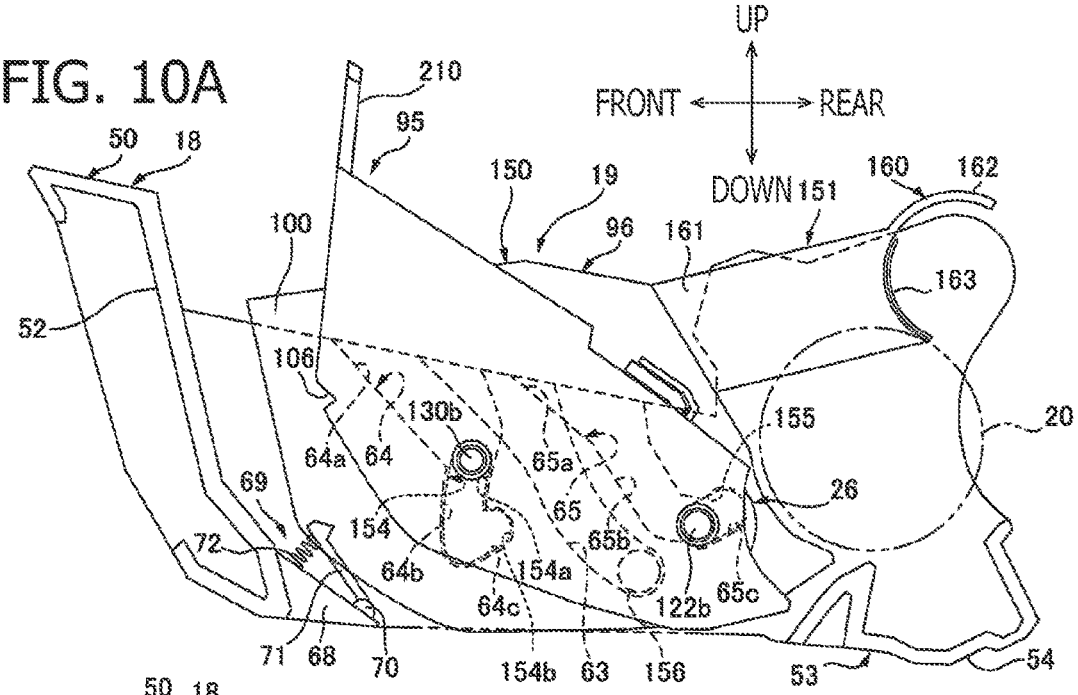

FIG. 10A is a side view showing an initial state where the developing unit and the waste toner box are to be attached to the drum cartridge.

Figure 10B:
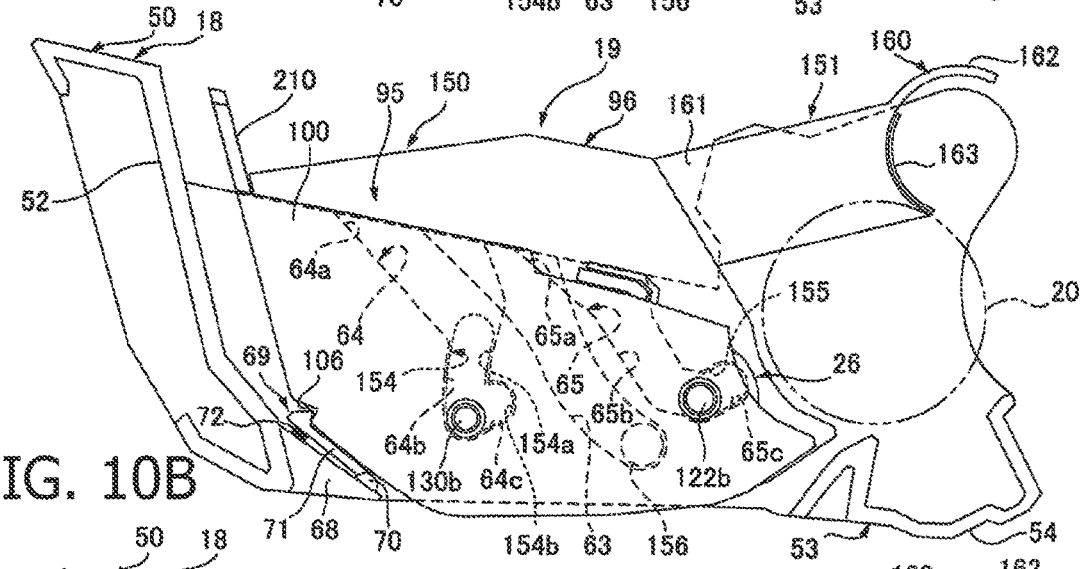

FIG. 10B is a side view showing a state where the developing unit and the waste toner box have been attached to the drum cartridge.

Figure 10C:
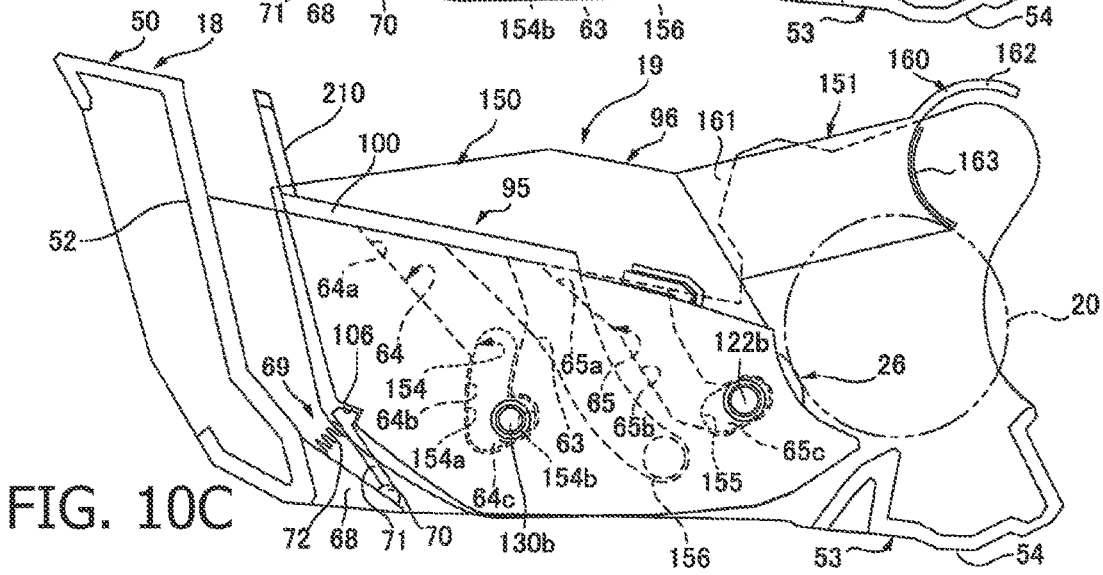

FIG. 10C is a side view showing a state where the developing unit and the waste toner box have been attached to the drum cartridge, and the developing unit is located on the rear side.

Figure 6:
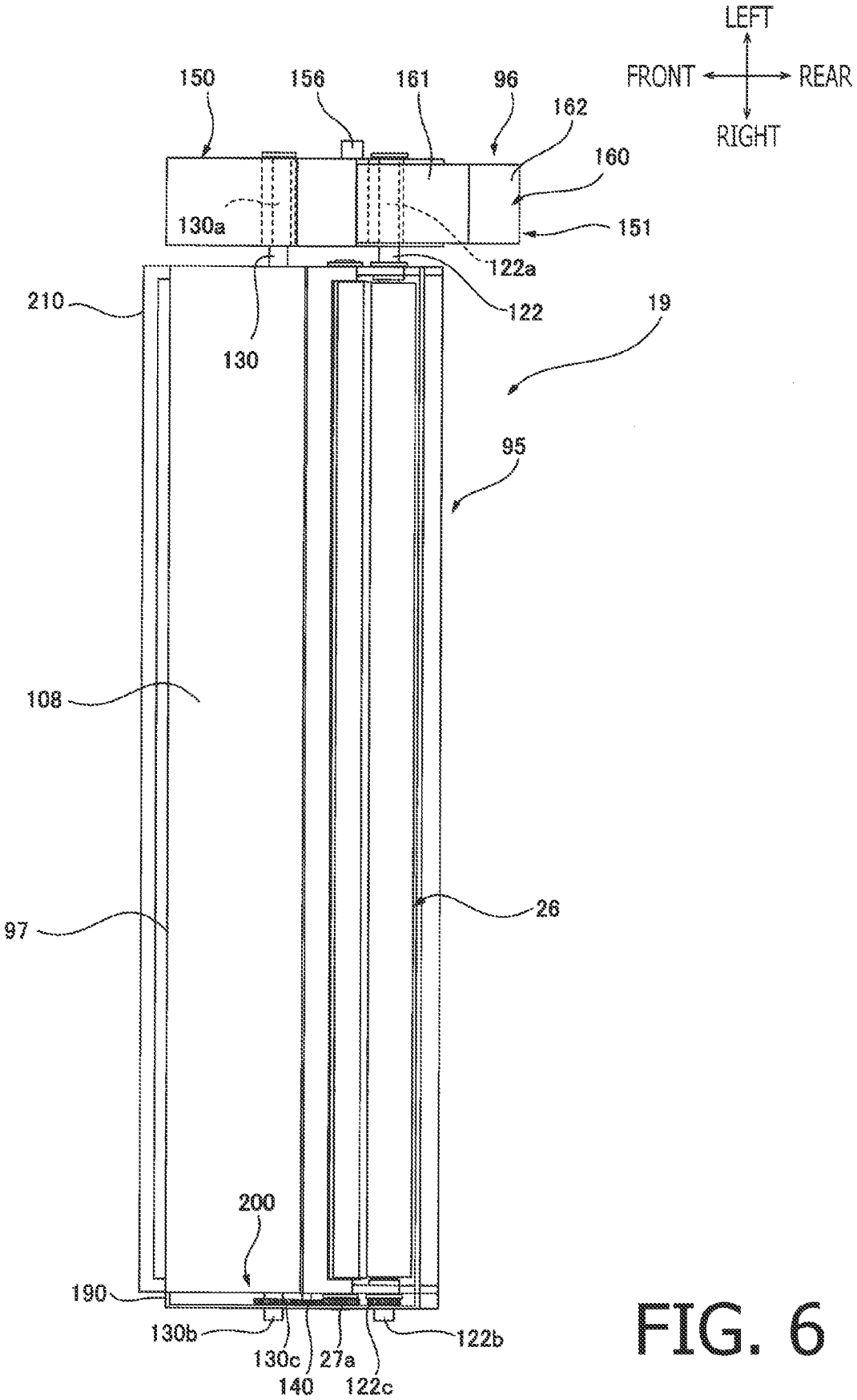
FIG. 6 is a plan view of a developer cartridge shown in FIG. 1.
Figure 11:
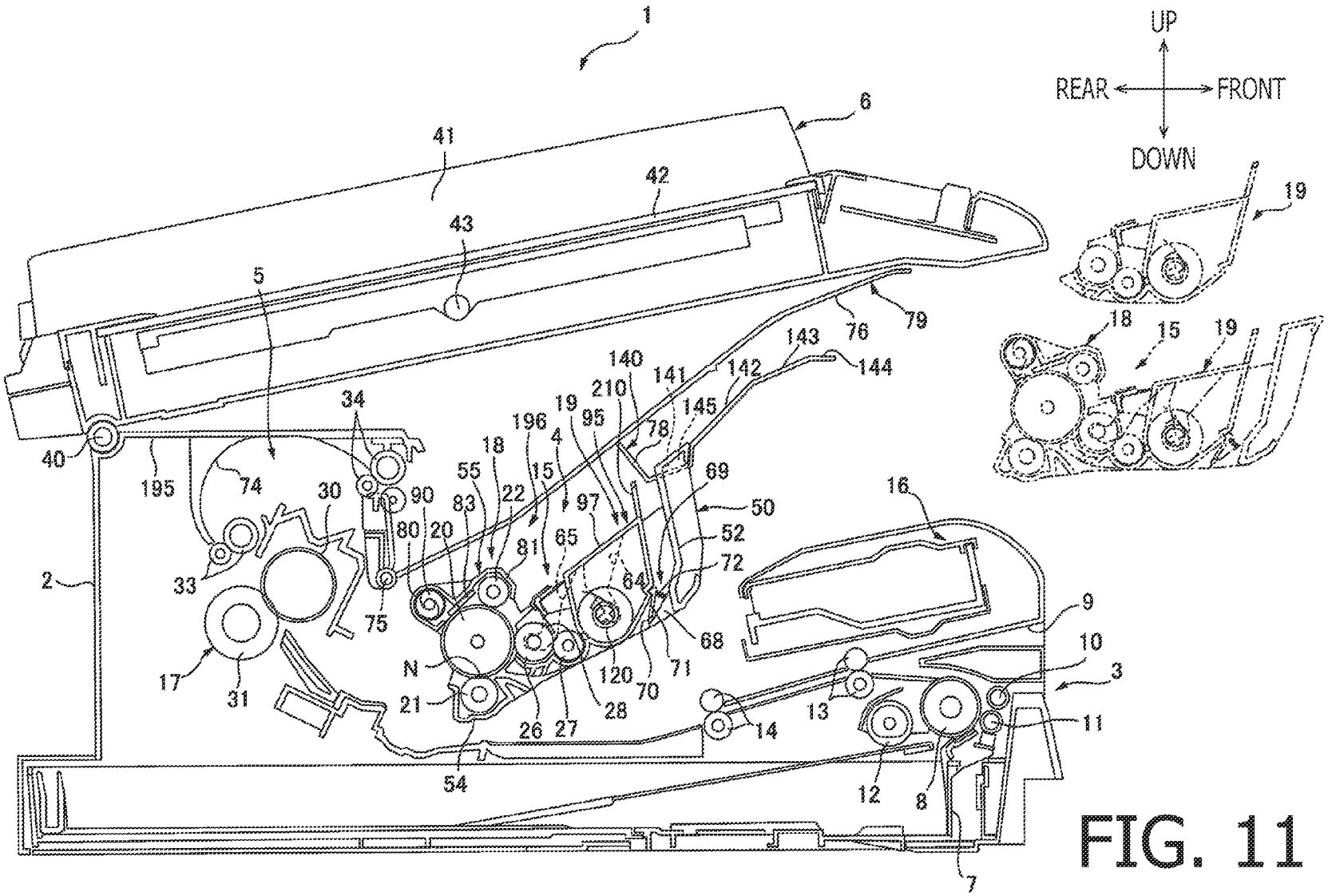

FIG. 11 is a cross-sectional view of the printer shown in FIG. 6 when the process cartridge is not attached.

Figure 1:
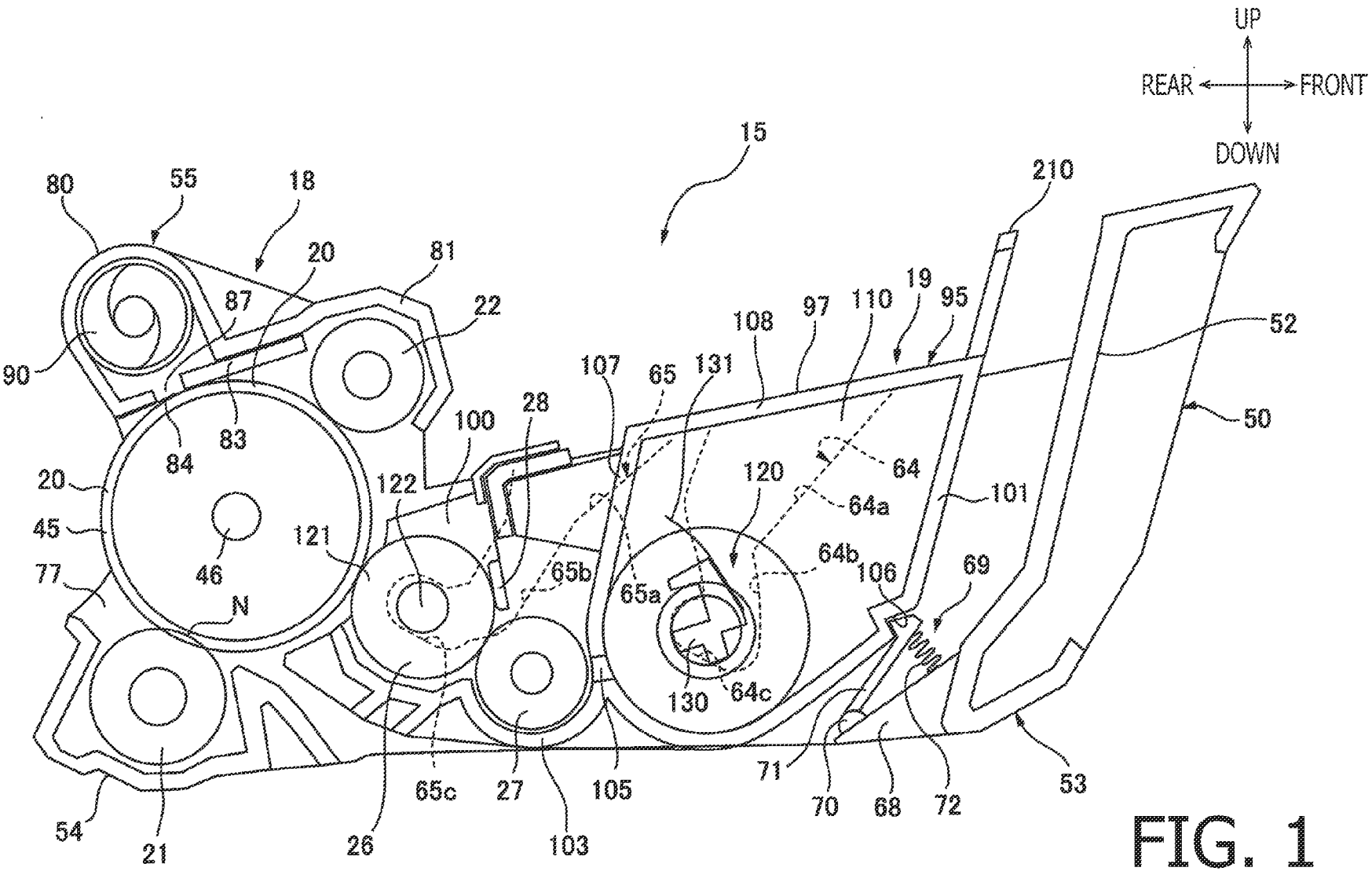
Figure 12:
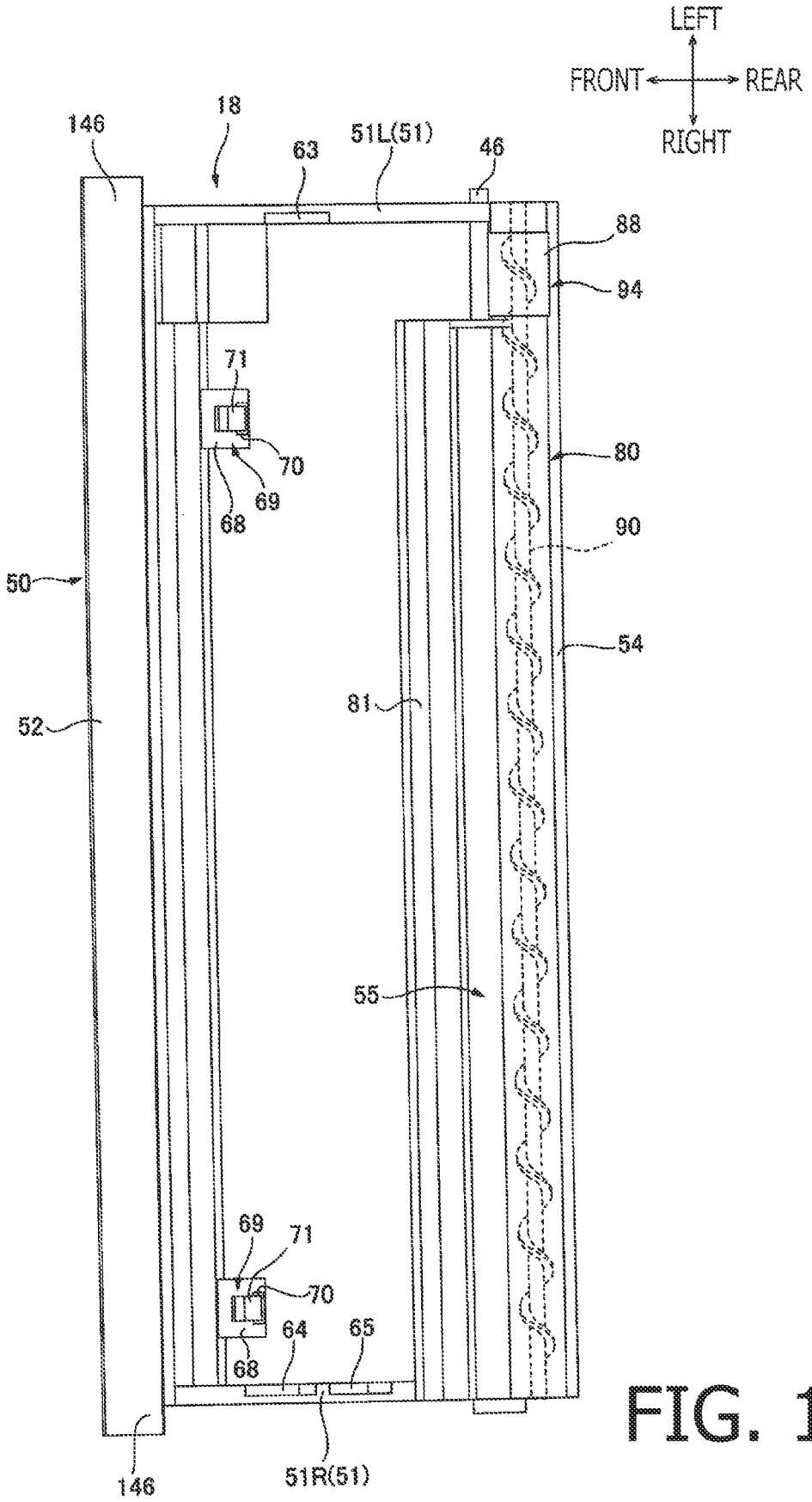

FIG. 12 is a plan view showing a modification of drum cartridge of the process cartridge shown in FIG. 1.

Figure 13:
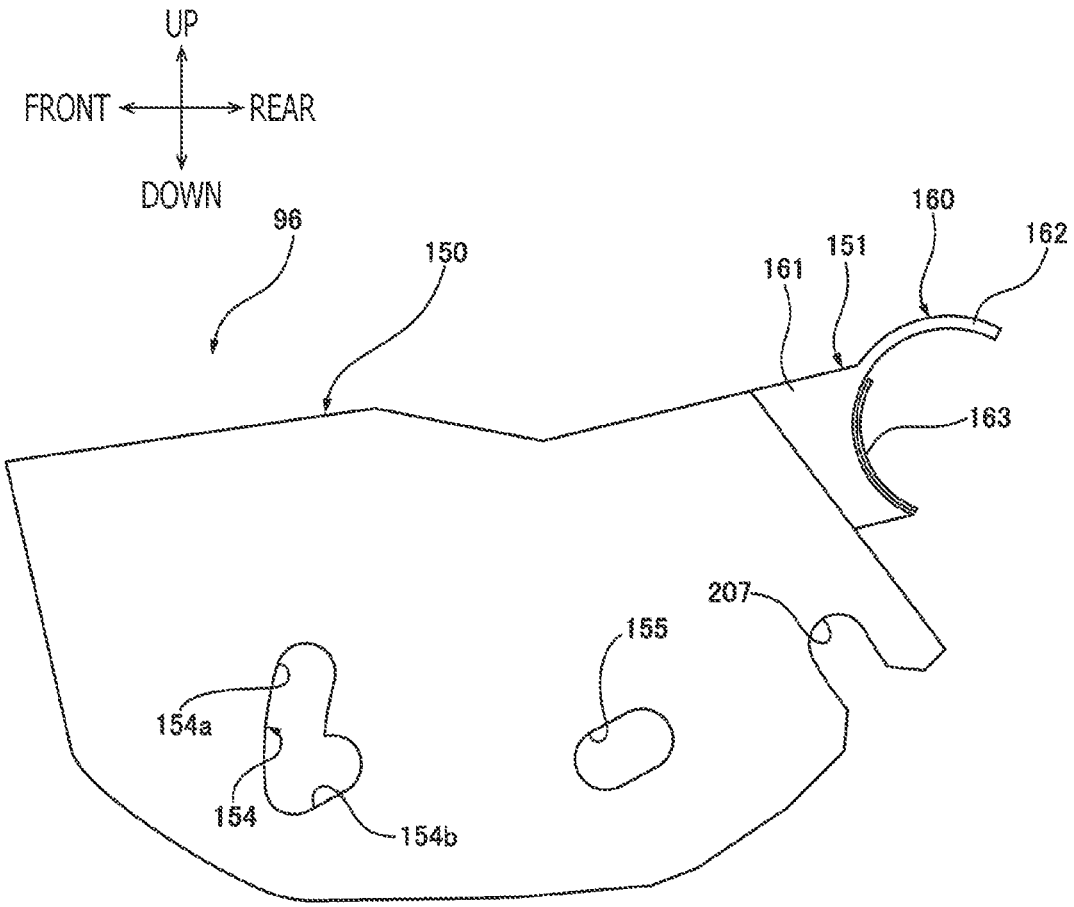

FIG. 13 is a side view showing a modification of the waste toner box of the process cartridge shown in FIG. 1.

Figure 14:
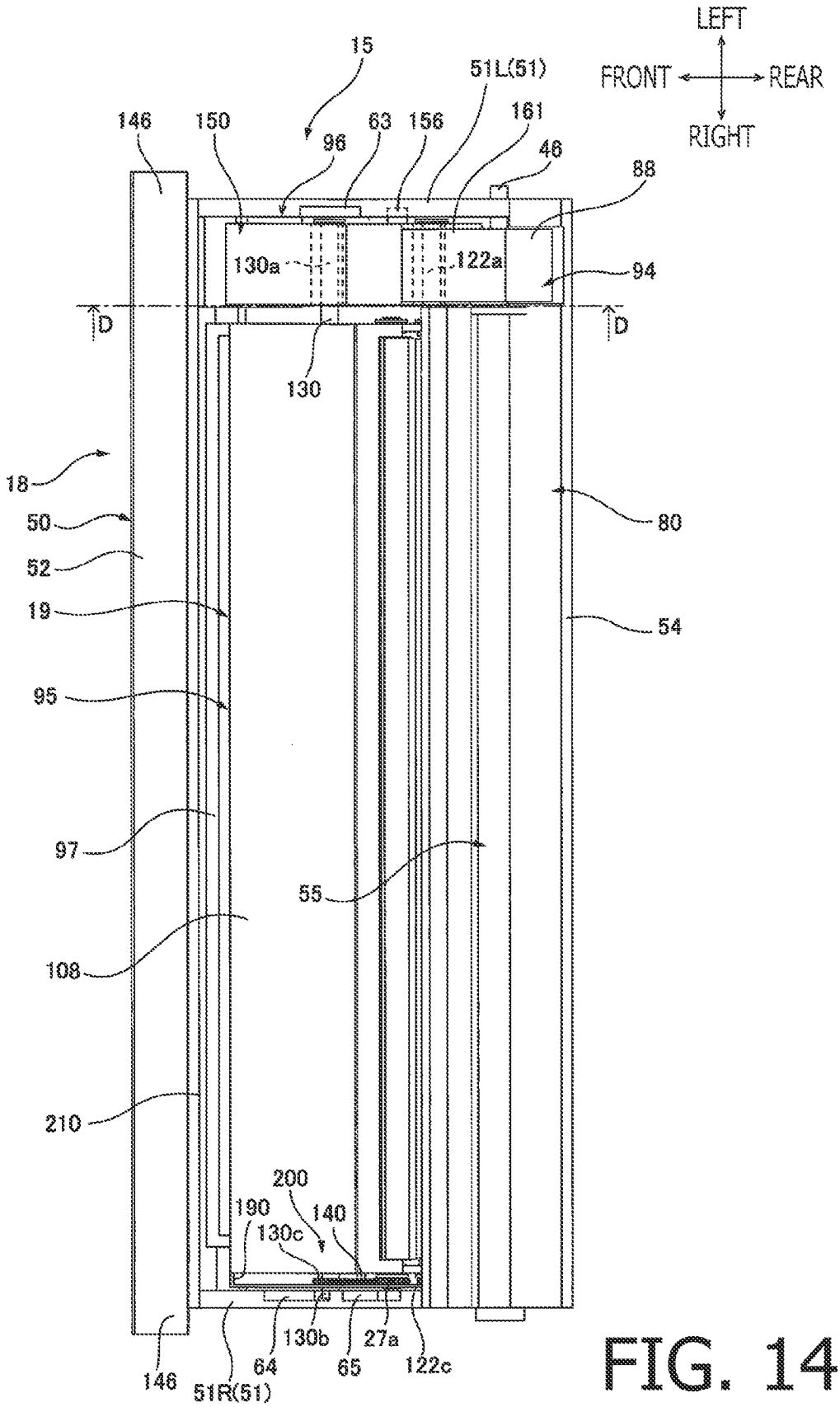

FIG. 14 is a plan view showing a modification of the process cartridge shown in FIG. 1.

Figure 15:
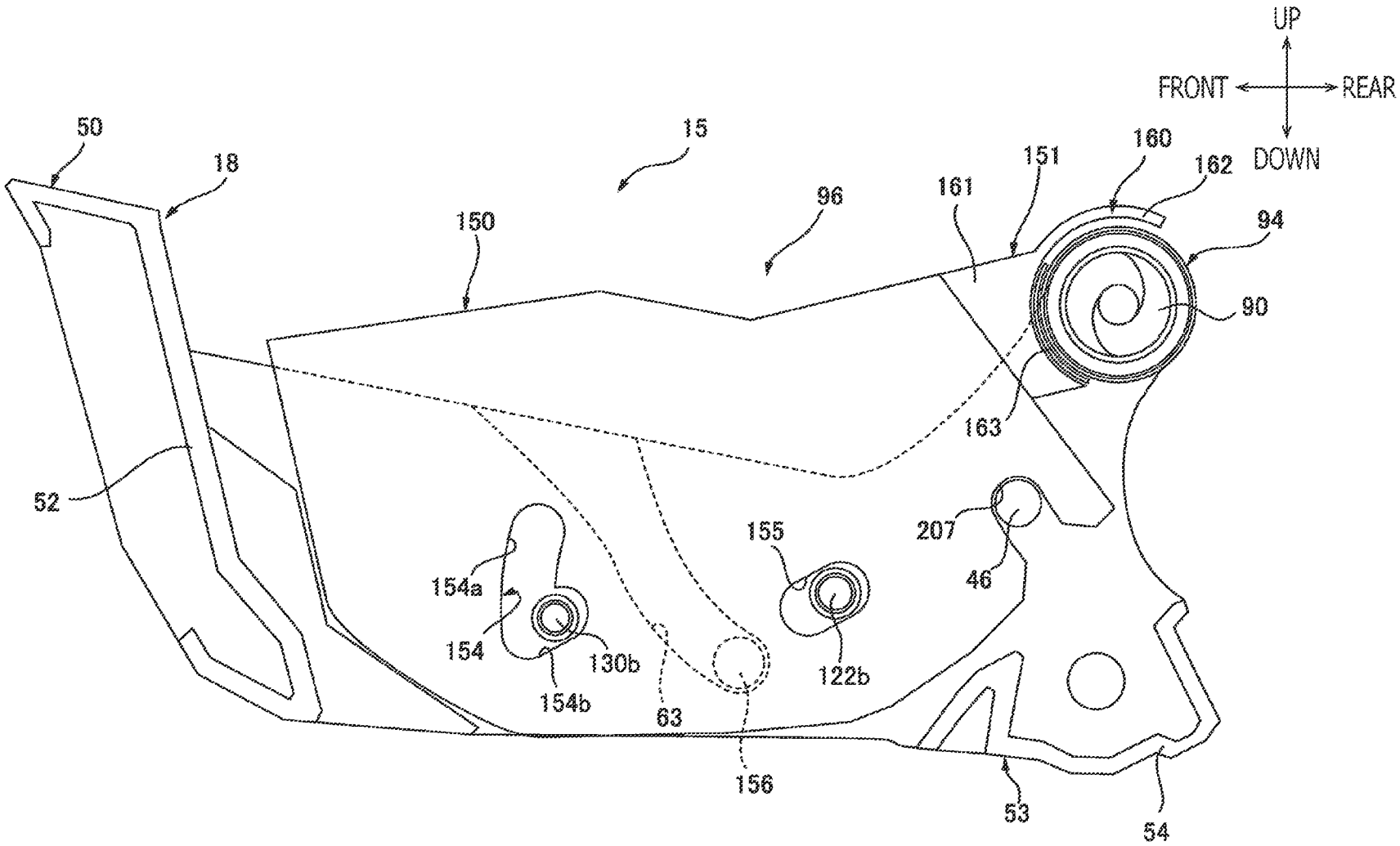

FIG. 15 is a cross-sectional view of the process cartridge taken along line D-D of FIG. 14.

DETAILED DESCRIPTION OF THE ILLUSTRATIVE EMBODIMENT

It is noted that various connections are set forth between elements in the following description. It is noted that these connections in general and, unless specified otherwise, may be direct or indirect and that this specification is not intended to be limiting in this respect.

A process cartridge 15 has a drum cartridge 18 and a developing cartridge 19 (see FIG. 1). It is noted that the drum cartridge 18 is an example of an image carrying unit according to aspects of the disclosure.

In the following description, directions are indicated based on a state where the process cartridge 15 is placed horizontally as shown in FIG. 1. That is, up and down directions in FIG. 1 are also up and down directions of the process cartridge 15, respectively. Further, a right hand side and a left hand side of FIG. 1 are a front side and a rear side of the process cartridge 15, respectively. Further, a right hand side and a left hand side of the process cartridge 15 when viewed from the front side are a right side and a left side of the process cartridge 15. Thus, a closer side with respect to a plane of FIG. 1 is the left side of the process cartridge 15, and a farther side with respect to a plane of FIG. 1 is the right side of the process cartridge 15.

The drum cartridge 18 accommodates a photoconductive drum 20 which an example of an image carrying member, a transfer roller 21 and a charging roller 22.

The photoconductive drum 20 is rotatably supported at a rear end part of the drum cartridge 18. The photoconductive drum 20 is a hollow cylindrical member, and is configured to be rotatable about a first axis L1 extending in the right-and-left direction (see FIG. 3).

The transfer roller 21 is arranged below the photoconductive drum 20. The transfer roller 21 is a hollow cylindrical member and an upper end part thereof contacts a lower end part of the photoconductive drum 20 (FIG. 1).

The charging roller 22 is arranged on an upper front position with respect to the photoconductive drum 20. The charging roller 22 is a solid cylindrical member, and a lower rear part thereof contacts an upper front part of the photoconductive drum 20 (FIG. 1).

The developing cartridge 19 has a developing unit 95.

The developing unit 95 is arranged on a front side with respect to the photoconductive drum 20. The developing unit 95 has a developing roller 26, a supplying roller 27, a layer thickness regulation blade (hereinafter, referred to as a regulation blade) 28 and a toner reservoir 10.

Figure 3:
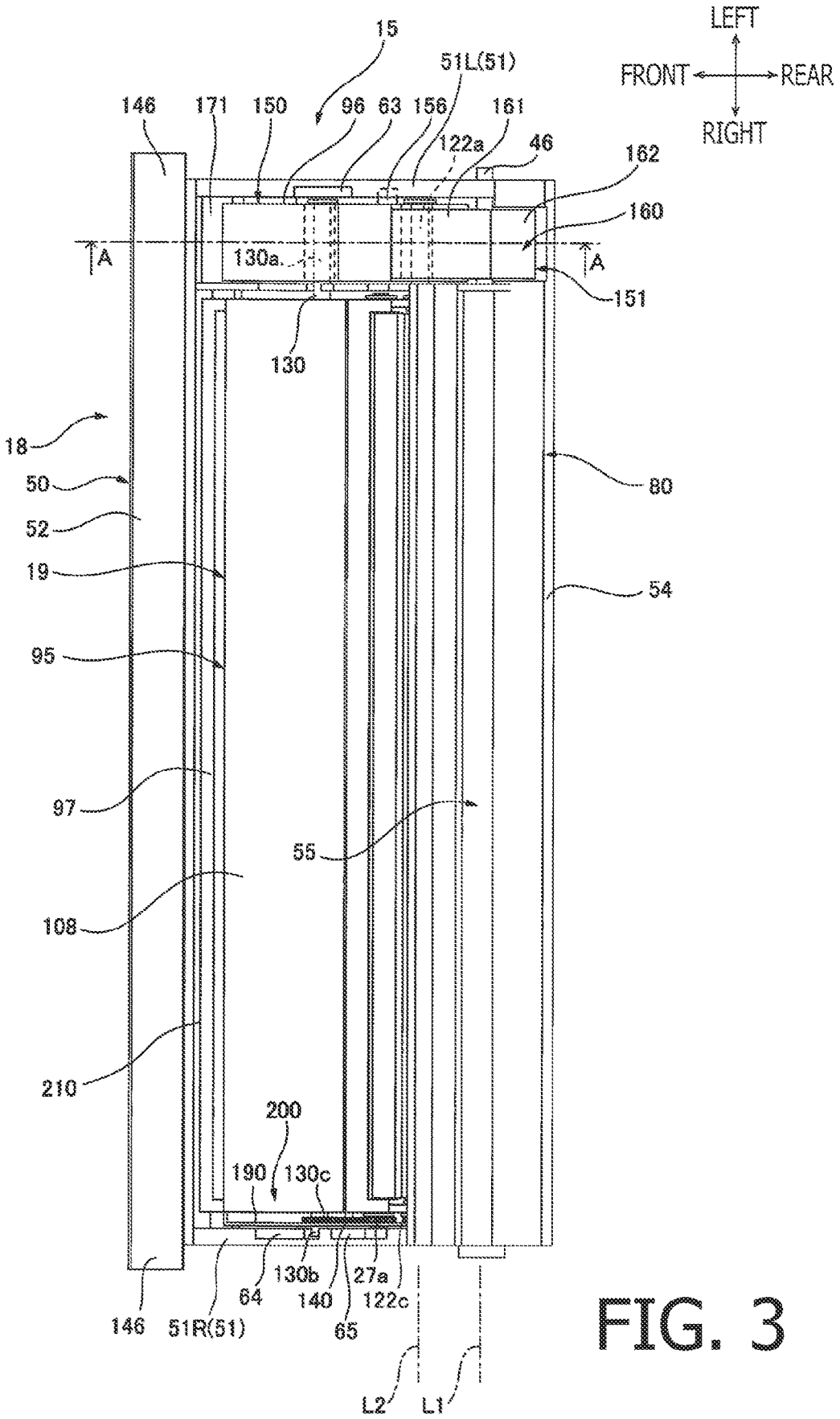
FIG. 3 is a plan view of the process cartridge shown in FIG. 1.

The developing roller 26 is arranged on a rear end part of the developing unit 95. The developing roller 26 is a solid cylindrical member and configured to be rotatable about a second axis L2 extending in the right-and-left direction (FIG. 3). An upper rear part of the developing roller 26 contacts a lower front part of the photoconductive drum 20 (FIG. 1).

The supplying roller 27 is rotatably supported on a lower front side with respect to the developing roller 26. An upper rear part of the supplying roller 27 contacts a lower front part of the developing roller 26 (FIG. 1).

The regulation blade 28 is arranged on a front side with respect to the developing roller 26 and extends in the up-and-down direction. A lower end part of the regulation blade 28 contacts a front end part of the developing roller 26.

The toner reservoir 110 is defined within a front side of the developing unit 95. The toner reservoir 110 extends in the right-and-left direction and has a substantially rectangular cross section. The toner reservoir 110 reserves toner therein. Further, an agitator 120 is provided inside the toner reservoir 110.

The agitator 120 extends in the right-and-left direction and rotatably supported in the toner reservoir 110.

Figure 2:
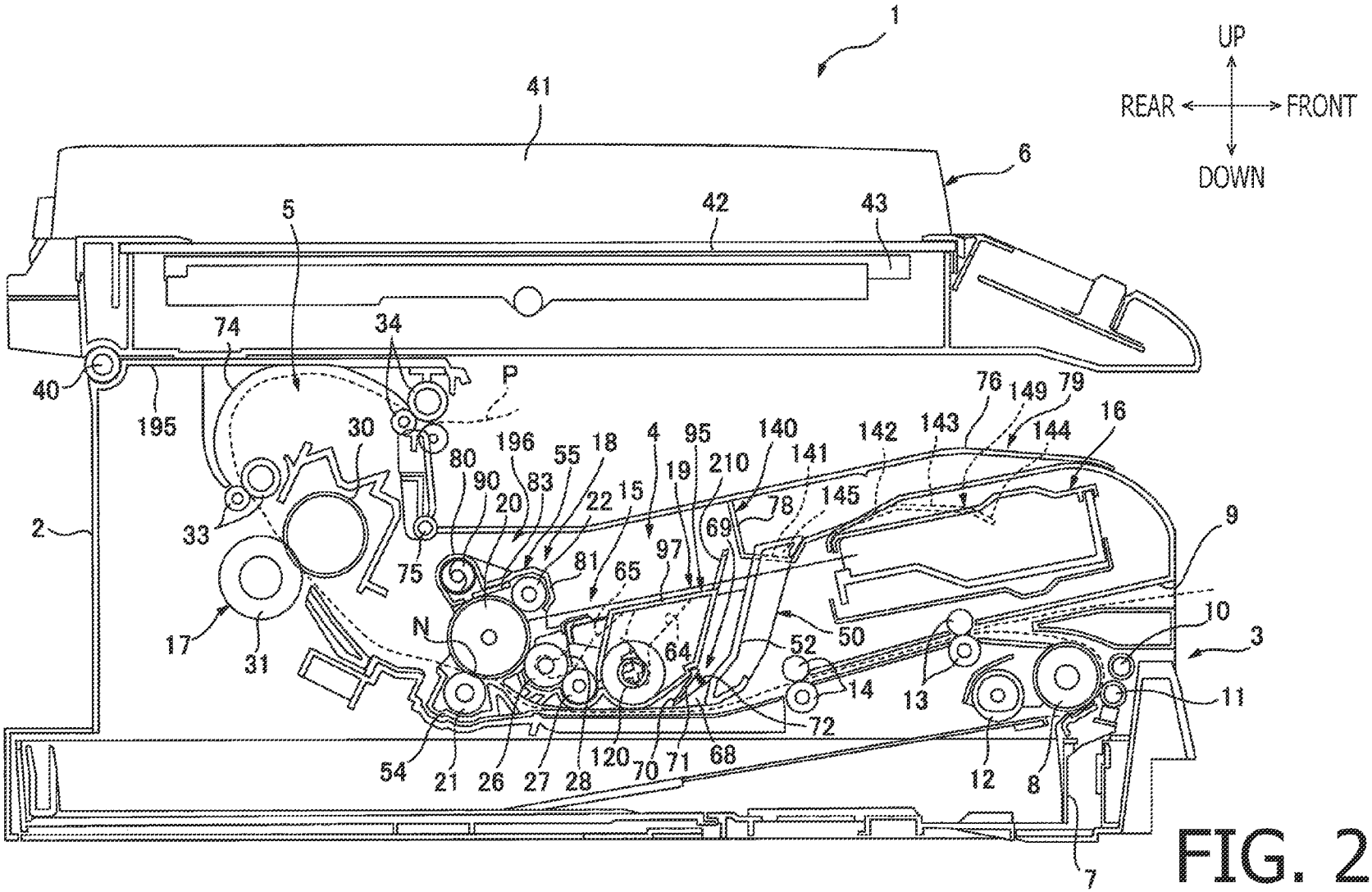
FIG. 2 is a cross-sectional side view of a printer to which the process cartridge shown in FIG. 1 is to be mounted.

The process cartridge 15 is mounted on a printer 1 when in use (see FIG. 2).

The printer 1 has a casing 2, a sheet supplying unit 3, an image forming unit 4, a sheet discharge unit 5, and a flatbed scanner 6.

The casing 2 has a rectangular box shape extending in the right-and-left direction.

The casing 2 has a top cover 79.

The top cover 79 has a rotation shaft 75, a cover body 76 and a cover guide 150.

The rotation shaft 75 is a solid cylindrical member extending in the right-and-left direction, and rotatably supported at a central portion inside the casing 2.

The cover body 76 is a plate member and extends from the rotation shaft 75 in a radial direction of the rotation shaft 75.

The cover guides 140 are arranged on a lower surface of the cover unit 76, and provided at front portions of right and left end parts of the cover body 76, respectively. Each cover guide 140 has a substantially L-shaped side view. Each cover guide 140 integrally has a regulating part 78 and a guide body 149.

The regulating parts 78 are connected to central parts in the font-and-rear direction at end portions in the right-and-left direction, respectively, and extend in a lower front direction.

The guide bodies 149 are connected to lower end parts of the regulating parts 78, respectively, and extend frontward. With this structure, the guide bodies 149 are substantially parallel with the cover body 79 and extend to be separated from the rotation shaft 75. Each of the guide bodies 149 integrally has an engaging part 141, a first cover guide 142, a second cover guide 143 and an introduction part 144.

Each engaging part 141 is connected to the lower end part of the regulating part 78, extends toward a lower front position, and is bent to extend toward an upper front position.

Each first cover guide 142 extends from the front end part of the engaging part 141 and is bent such that an inclination thereof in the front direction becomes greater than the inclination of the front part of the engaging part 141 and slightly inclines upward toward the front side.

Each second cover guide 143 is connected to the front end part of the first cover guide 142, bent thereat, and extends to incline downward toward the front side.

Each introduction part 144 is connected to the second cover guide 143, bent thereat, and extends to incline downward, in comparison with the inclination of the second cover guide, toward the front side.

The top cover 79 is configured to be rotatably moved about the rotation shaft 75 between a close position at which the top cover 79 closes a process opening 196 and an open position at which the top cover 79 does not cover the process opening 196.

The sheet supply unit 3 has a sheet cassette 7, a sheet feed roller 8, a sheet opening 9, a second pinch roller 10, a pickup roller 12, a pair of first conveying rollers 13, and a pair of second conveying rollers 14.

The sheet cassette 7 is arranged on a lower part inside the casing 2. The sheet cassette 7 is detachably attached to the casing 2. The sheet cassette 7 has a box-like shape which is opened upward, and is configured to accommodate a plurality of sheets P to be supplied to the process cartridge 15.

The sheet feed roller 8 is a hollow cylindrical member extending in the right-and-left direction, and is arranged above the front end part of the sheet cassette 7.

The sheet opening 9 is formed at a central part of a front wall of the casing 2.

The first pinch roller 11 is arranged on a front side with respect to the sheet feed roller 8. The first pinch roller 11 is a solid cylindrical member extending in the right-and-left direction. A rear end part of the first pinch roller 11 contacts a front end part of the sheet feed roller 8.

The second pinch roller 12 is arranged on an upper front side with respect to the first pinch roller 11 and on a front side with respect to the sheet feed roller 8 with a space therebetween. The second pinch roller 12 is a solid cylindrical member extending in the right-and-left direction.

The first feed rollers 13 are arranged below a scanner unit 16, and on the rear side with respect to the sheet feed roller 8. Each of the first feed rollers 13 is a solid cylindrical member extending in the right-and-left direction, and the two first feed rollers 13 contact each other in the up-and-down direction.

The pair of second feed rollers 14 is arranged on a lower rear side with respect to the pair of first feed roller 13 with a space therebetween, and is arranged on a rear side with respect to the scanner unit 16. Each of the second feed rollers 14 is a solid cylindrical member extending in the right-and-left direction, and the two second feed rollers 14 contact each other in the up-and-down direction.

The image forming unit 4 has the process cartridge 15, the scanner unit and a fixing unit 17.

The process cartridge 15 is detachably attached to a central part of a side surface of the casing 2.

The scanner unit 16 is arranged on the front side with respect to the process cartridge 15. The scanner unit 16 is arranged along a direction connecting an upper front position and a lower rear position so as to downwardly incline toward the rear side. The scanner unit 16 is configured to emit a laser beam L to the photoconductive drum 20 based on image data.

The fixing unit 17 has a heat roller 30 and a pressure roller 31.

The heat roller 30 is arranged on an upper rear side with respect the process cartridge 15 with a space therebetween.

The pressure roller 31 is arranged on a lower rear side with respect to the heat roller 30. An upper front end part of the pressure roller 31 contacts a lower rear end part of the heat roller 30.

The sheet discharge unit 5 has a pair of guide rollers 33, a pair of discharge rollers 34 and a discharge guide 74. A flatbed support wall 195 is arranged above the discharge part 5. The discharge part 5 is arranged at a higher position than the top cover 79.

The pair of guide rollers 33 is arranged on an upper rear side with respect to the fixing unit 17 with a space therebetween.

The pair of discharge rollers 34 is arranged on an upper front side with respect to the fixing unit 17 with a space therebetween, and on a rear side with respect to the photoconductive drum 20.

The discharge guide 74 is arranged between the pair of guide rollers 33 and the pair of discharge rollers 34. The discharge guide 74 has a U-shaped side view, which extends upward from a position in the vicinity of the pair of guide rollers, is bent frontward, and then extends to a position in the vicinity of the pair of discharge rollers 34.

The flatbed scanner 6 is arranged above the casing 2, and has a shaft 40, a holding cover 41, a glass surface 42 and a CCD (charge coupled device) sensor 43.

The shaft 40 is provide at a lower rear part of the flatbed scanner 6. The shaft 40 is a hollow cylindrical member extending in the right-and-left direction, and rotatably supported at a rear end part of the discharge unit 5. With this structure, the flatbed scanner 6 can be rotated with respect to the casing 20 about the shaft 40.

The flatbed scanner 6 is configured to scan image information of an original sheet place between the holding cover 41 and the glass plate 42 with the CCD 43.

The printer 1 starts an image forming operation under control of a controller (not shown). When the image forming operation is started, the charging roller 22 uniformly charges a circumferential surface of the photoconductive drum 20.

Thereafter, the scanner unit 16 emits a laser beam in a lower rear direction toward the circumferential surface of the photoconductive drum 20. The front side circumferential surface of the photoconductive drum 20 is exposed to the laser beam, and an electrostatic latent image in accordance with image data is formed on the circumferential surface of the photoconductive drum 20. It is noted that the image may be one transmitted from a personal computer (not shown) or the like connected to the printer 1 or image data generated by the flatbed scanner 6.

The agitator 120 agitates the toner reserved in the toner reservoir 110, and supplies the agitated toner to the toner supply roller 27. The toner supply roller 27 supplies the toner supplied from the agitator 120 to the developing roller 26. It is noted that the toner is charged in positive polarity between the developing roller 26 and the toner supplying roller 27, and held by the developing roller 26. The layer thickness regulation blade 28 regulates the thickness of the toner held on the develop to a predetermined thickness.

The developing roller 26 supplies the toner having a predetermined thickness and carried on its circumferential surface to the electrostatic latent image on the circumferential surface of the photoconductive drum 20. As a result, a toner image is formed on the circumferential surface of the photoconductive drum 20.

The plurality of sheets P accommodated in the sheet cassette 7 are fed to the sheet feed roller 8. The sheets P are conveyed one by one at every predetermined timing toward an upper rear direction such that it makes a U-turn and is further conveyed to a nip N between the photoconductive drum 20 and the transfer roller 21. As each sheet P passes the nip N, the transfer roller 21 causes the photoconductive drum 20 to transfer a toner image to the sheet P.

The sheet P on which the toner image has been transferred is further conveyed toward the fixing unit 17 as the photoconductive drum 20 and various rollers rotate, and finally passes through a nip between the heat roller 30 and the pressure roller 31. When the sheet P passes, the heat roller 30 and the pressure roller 31 apply heat and pressure to the sheet P to fix the image thereon.

The sheet P on which the toner image is fixed is passed through the nip between the guide rollers 33, guided by the discharge guide 74 to proceed forward to make a U-turn, and reaches the nip between the discharge rollers 34.

The discharge rollers 34 rotate to discharge the sheet P onto the top cover 79 through the discharge opening 68.

The drum cartridge 18 has a drum frame 50 (see FIGS. 1 and 5). The drum frame 50 has a frame-like shape and a substantially rectangular plan view extending in the right-and-left direction. The drum frame 50 has a lower frame 53 and an upper frame 55.

The lower frame 53 has a pair of side walls 51, a partition wall 56, a front wall 52 and a bottom wall 54.

The side walls 51 are arranged to be spaced from each other in the right-and-left direction. Each of the side walls 51 has a plate-like member extending in the front-and-rear direction, and has a substantially rectangular side view. In the following description, when the right and left side walls 51 are also referred to as a right wall 51R and a left wall 51L, respectively, when they are described separately.

Figure 7A:
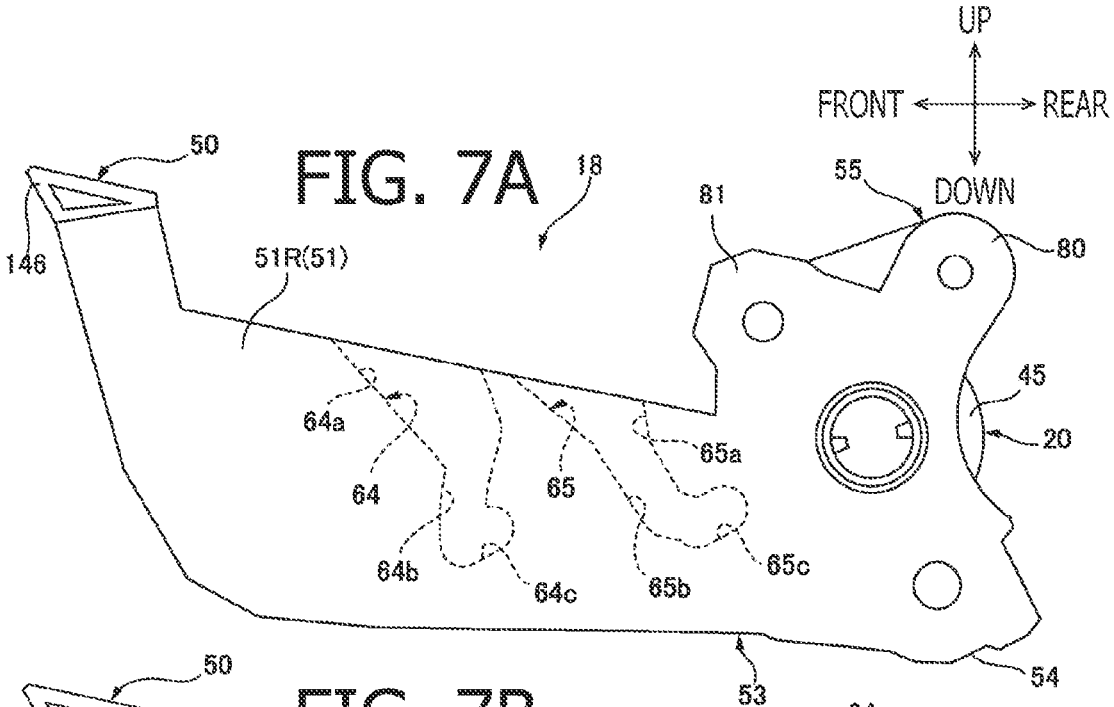
FIG. 7A is a side view of the drum cartridge shown in FIG. 4 viewed from right.
Figure 7B:
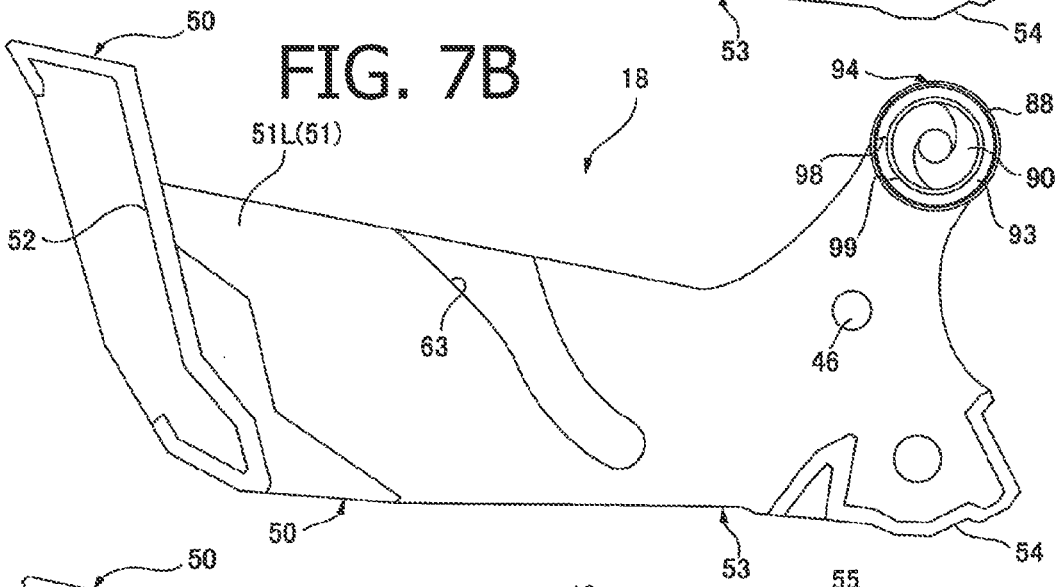
FIG. 7B is a cross-sectional view of the drum cartridge shown in FIG. 4 taken along line B-B of FIG. 4.

As shown in FIGS. 5 and 7A, the right wall 51R has a front guide 64 and a rear guide 65.

The front guide 64 is arranged on a left end surface of the right wall 51R, at a slightly frontward central portion. The front guide 64 has a first part 64*a*, a second part 64*b* and a third part 64*c*.

The first part 64*a* extends downward from an upper central position of the right wall 51R. The first part 64*a* is formed such that the lower part has a narrower width. It is noted that the width of the first part 64*a* is greater than a diameter of an agitator shaft 130 which will be described later.

The second part 64*b* extends downward from a lower end part of the first part 64*a*. A lower end part of the second part 64*b* is located at a position slightly above a central part of a lower end of the right wall 51R. A width of the second part 64*b* is substantially the same as the diameter of the agitator shaft 130 which will be described later.

The third part 64 extends toward an upper rear direction from a lower end part of the second part 64*b*. A width of the third part 64*c* is substantially the same as the diameter of the agitator shaft 130.

The rear guide 65 is arranged on the rear side with respect to the front guide 64. The rear guide 65 has a fourth part 65*a*, a fifth part 65*b* and a sixth part 65*c*.

The fourth part 65*a* extends downward from a central part of an upper end of the right wall 51R. The fourth part 65*a* is formed such that a lower part has a narrower width. The width of the fourth part 65*a* is greater than a diameter of a developing roller shaft 122.

The fifth part 65*b* extends in a lower rear direction from an lower end part of the fourth part 65*a*, and then extends rearward. A lower end part of the fifth part 65*b* is located at a slight upper rear position with respect to a central part of a lower end part of the right wall 51R. A width of the fifth part 65*b* is substantially the same as the diameter of the developing roller shaft 122.

The sixth part 65*c* extends in an upper rear direction from a lower end part of the fifth part 65*b*. A width of the sixth part 65*c* is substantially the same as the diameter of the developing roller shaft 122.

The left wall 51L has a left guide 63.

The left guide 63 is arranged on a right end surface of the left wall 51L, and extends in a lower rear direction from a central part of an upper end of the left wall 51L. The lower end part of the left guide 63 is located at slightly above a central part of a lower end part of the left wall 51L. The left guide 63 is formed such that a width thereof is substantially the same as or greater than a diameter of a boss 156.

The partition wall 56 is arranged between the right wall 51R and the left wall 51L and closer, in the right-and-left direction, to the left wall 51L (see FIG. 5). The partition wall 56 is a plate-like member having a rectangular side view. The partition wall 56 extends in the front-and-rear direction, parallel to the right wall 51R and the left wall 51L (see FIG. 7C).

The partition wall 56 has a front guide 85 and a rear guide 86.

The front guide 85 is formed to penetrate the partition wall 56 in the right-and-left direction at a position slightly front side of a central area of the partition wall. The front guide has a first par 85*a*, a second part 85*b* and a third part 85*c*.

The first part 85*a* extends in a lower down from a central portion of an upper end of the partition wall 56. The first part 85*a* is formed such that the width is smaller at the lower rear portion. The width of the first par 85*a* is greater than an agitator shaft 130, which will be described later.

The second part 85*b* extends downward from a lower end part of the first part 85*a*. A lower end part of the second part 85*b* is located on a slightly upper front direction with respect to a central portion of an lower end part of the partition wall 56. The width of the second part 85*b* is substantially the same as the diameter of the agitator shaft 130, which will be described later.

The third part 85*c* extends in an upper rear direction from the lower end part of the second part 85*b*. A width of the third part 85*c* is substantially the same as the diameter of the agitator shaft 130.

A rear guide 86 penetrates through the partition wall 56 in the right-and-left direction, and is arranged at a slightly rear position of the central part of the left end surface of the partition wall 56. The rear guide 86 has a fourth part 86*a*, a fifth part 86*b* and a sixth part 86*c*.

The fourth part 86*a* extends in a lower rear direction from a central part of an upper end of the partition wall 56. The fourth part 86*a* is formed such that a width is smaller at a lower rear position thereof. The width of the fourth part 86*a* is greater than the diameter of the developing roller shaft 122.

The fifth part 86*b* is formed to extend in a lower rear direction from a lower end part of the fourth part 86*a*, and then extends rearward. A lower end of the fifth part 86*b* is located at slightly upper rear position with respect to the central portion of the lower end part of the partition wall 56. A width of the fifth part 86*b* is substantially the same as the diameter of the developing roller shaft 122.

The sixth part 86*c* extends in an upper rear direction from a lower end part of the fifth part 86*b*. A width of the sixth part 86*c* is substantially the same as the diameter of the developing roller shaft 122.

The front wall 52 is configured to bridge between a front end part of the right wall 51R and a front end part of the left wall 51L, and extends in the right-and-left direction. The front wall 52 is plate-like member having a substantially rectangular front view. The front wall 52 has a pair of protruded parts 146 and a pair of supporting parts 68.

The protruded parts 146 are arranged at right and left end parts at an upper portion of the front wall 52, respectively. Each protruded part 146 protrudes from the front wall 52 outwardly, in the right-and-left direction.

The supporting parts 68 are arranged inside, in the right-and-left direction, of the right wall 51R and the partition wall 56, and protrudes rearward from a lower end part of the front wall 52. Each of the supporting parts 68 has an urging member 69.

Each urging member 69 has a stationary part 70, an engaging part 71 and a spring 72.

The stationary part 70 is formed at a distal end part of the supporting part 68 and extends in the right-and-left direction.

The engaging part 71 is a plate-like member having an L-shaped side view extending from an upper front position to a lower rear position. A lower end of the engaging part 71 is rotatably secured to the stationary part 70. An upper end part of the engaging part 71 is bent toward an upper rear position.

One end of the spring 72 is secured to a proximal end part of the supporting part 68, and the other end is secured to an upper end part of the engaging part 71.

The lower wall 54 is configured to bridge between an lower rear end part of the right wall 51R and a lower rear end part of the left wall 51L, and extends in the right-and-left direction. The lower wall has a substantially U-shaped side view opened to upside so that the lower wall 54 extends to surround along the transfer roller 21.

The front wall 52, the right wall 51R, the partition wall 56 and the front end part of the photoconductive drum 20 define the unit attaching part 170.

Further, the front wall 52, the left wall 51L, the partition wall 56 and a drum side attaching part 94 (described later) define a box containing part 171.

The upper frame 55 is located above the photoconductive drum 20. The upper frame 55 has a screw containing part 80, a charging roller containing part 81, a screw 90, a blade 83 an a film 84.

The screw containing part 80 is arranged on a rear side of the upper frame 55, and is formed to bridge between the right wall 51R and the left wall 51L. The screw containing part 80 is formed to is a hollow cylindrical part having a substantially U-shaped cross section which is opened downward. An opened area between a lower end part on the rear side of the screw containing part 80 and an upper end part on the rear side of the lower frame 54 is defined as a sheet discharging opening 77 through which the sheet P passed through the nip between the photoconductive drum 20 and the transfer roller 21. The screw containing part 80 has a drum side attaching part 94.

As shown in FIGS. 3 and 4, the drum side attaching part 94 is on a left end part of the screw containing part 80, and has a curved part 93 and a drum side shutter 88.

The curved part 93 has a hollow cylindrical part extending in the right-and-left direction. On a front side circumferential surface of the curved part 93, a drum side opening 89 is formed.

The drum side shutter 88 has a hollow cylindrical shape extending in the right-and-left direction. Specifically, the drum side shutter 88 is movably attached to the curved part 93 such that the drum side shutter 88 covers the curved part 93. On a circumferential surface of the drum side shutter 88, a drum shutter opening 99 is formed.

When the drum side shutter 88 moves along the curved part 93 and the drum shutter opening 99 meets the drum side opening 98, the drum side opening 98 is opened. When the drum side shutter 88 further moves along the curved part 93 and the drum shutter opening 99 is shifted upward with respect to the drum side opening 98, the drum side opening 98 is closed.

The screw 90 is accommodated inside a curved part of the screw containing part 80. The screw 90 is an elongated screw extended in the right-and-left direction, both end parts of which are rotatably supported by the side walls 51.

The blade 83 is a planar plate-like member having a substantially rectangular plan view. The blade 83 extends in an upper front direction from a lower rear part of an front side lower end part of the screw container 80. The blade 83 is attached to a lower front end part of the screw containing part 30 and a lower rear end part of a charge roller containing part 81 which will be described later. The rear part of the blade 83 protrudes in a lower rear direction from a front end part of the screw containing part 80. The read end part of the blade 83 contacts the upper end part of the photoconductive drum 20. Between a rear end part of the blade 83 and a lower rear end part of the screw containing part 80, a collection opening 87 is formed. The blade 83 is arranged at an upper position with respect to the photoconductive drum 20 in the vertical direction.

The film 84 is attached to a lower rear end part of the screw containing part 80. The film 84 is a flexible film, and has a substantially rectangular plan view extending in the right-and-left direction. The film 84 extends in an upper front direction from the lower rear end part of the screw containing part 80. A front end part of the film 84 is slightly spaced from the rear end part of the blade 83. The front end part of the film 84 contacts the upper end part of the photoconductive drum 20.

The charging roller containing part 81 is arranged on a front end side of the partition wall 56, and is bridged between a rear part of the upper end part of the left wall 51L and a rear part of the upper end part of the right wall 51R. The charging roller containing part 81 is curved to extend along the circumferential surfaced of the charging roller 22.

As shown in FIGS. 1 and 3, the photoconductive drum 20 has a main body 45 and a shaft 46.

The drum body 45 has a cylinder part extending in the right-and-left direction and formed of metal, and a photoconductive layer covering a circumferential surface of the cylindrical part.

The drum shaft 46 is a solid cylinder member extending in the right-and-left direction. The length of the drum shaft 46 in the right-and-left direction is longer than a length of the drum body 45 in the right-and-left direction. The drum shaft 46 is arranged inside the drum body 45 such that a central axis of the drum shaft 46 coincides with a central axis of the drum body 45.

The photoconductive drum 20 is arranged such that both right and left end portions of the drum shaft 46 are rotatably supported by the side walls 51, respectively. The left end part of the drum shaft 46 is exposed to the unit attaching part 170 arranged between the partition wall 56 and the left wall 51L.

The developing cartridge 19 has a developing unit 95 and a waste toner collecting box 96 (see FIGS. 1 and 5).

The developing unit 95 has a developing frame 97 and a driving unit 200.

The developing frame 97 integrally has a pair of side walls 100, a front wall 101, a rear wall 107, an upper wall 108, and a bottom wall 103. The developing frame 97 rotatably supports the developing roller 26, the supplying roller 27, the thickness regulation blade 28, and the agitator 120.

The two side walls 100 are arranged to be spaced from each other. Each of the side walls 100 is a plate member having a rectangular side view extending in the right-and-left direction.

The front wall 101 is bridged between front parts of the two side walls 100. The front wall 101 is a plate like member having a substantially rectangular shape extending in the right-and-left direction. The front wall has a recessed part 106 and a grip part 210.

The recessed part 106 is arranged at a lower end part of the front wall 101, and formed to recess toward the rear direction.

The grip part 210 extends in an upper front direction from an upper end part of the front wall 101.

The rear wall 107 is arranged to be bridged between central parts of the two side walls 100. The front wall 101 is a plate-like member having a rectangular front view extending in the right-and-left direction. The rear wall 107 has a communication opening 105.

The communication opening 105 is arranged to be penetrated at a lower end part of the rear wall 107.

The upper wall 108 is arranged to bridge between central parts of the respective side walls 100, and between an upper end part of the front wall 101 and an upper end part of the rear wall 107. The upper wall 108 is a plate-like member having a rectangular plan view and extending in the right-and-left direction.

The bottom wall 103 is bridged between the lower end parts of the side walls 100, and between the lower end parts of the front wall 101 and the rear wall 107. The bottom wall 103 is a plate-like member extending in the right-and-left direction, and has a rectangular pan view.

The space defined by the pair of side walls 100, the front wall 101, the rear wall 107, the upper wall 108 and the bottom wall 103 is the toner reservoir 110.

The developing roller 26 has a roller body 121 and the developing roller shaft 122 (FIGS. 1 and 6).

The roller body 121 is arranged between the rear parts of the side walls 100, and has a substantially cylindrical tubular shape. The length of the roller body 121 in the right-and-left direction is shorter than a distance between the side walls 100 in the right-and-left direction.

The developing roller shaft 122 has a shape of a cylindrical column extending in the right-and-left direction. The length of the developing roller shaft 122 is shorter than a length of the developing frame 97 in the right-and-left direction. The developing roller shaft 122 is inserted in the roller body 121 such that both end parts of the roller shaft 122 slightly protrude outward with respect to the roller body 121 in the right-and-left direction. Further, right and left end parts of the developing roller shaft 122 is rotatably supported by the corresponding side walls 100. The right and left end parts of the developing roller 26 are rotatably supported by the side walls 100. That is, the developing roller 26 extends in the right-and-left direction, and is rotatable about a second axis L2 which is parallel to the first axis L1. As above, the developing roller 26 is rotatably supported by the developing frame 967.

The right and left end parts of the developing roller shaft 122 are protruded outward from the corresponding side walls 100, respectively. Further, a developing roller left end shaft 122*a*, which is a left end part of the developing roller shaft 122, protrudes leftward from the left side wall 100. A developing roller right end shaft 122*b*, which is a right end part of the developing roller shaft 122, protrudes rightward from the right side wall 100.

The agitator 120 has an agitator shaft 130 and an agitator blade 131.

The agitator shaft 130 is a cylindrical column member extending in the right-and-left direction. The length of the agitator shaft 130 is longer than the length of the developing frame 97 in the right-and-left direction. Further, the right and left end parts of the agitator shaft 130 are rotatably supported by the corresponding side walls 100, respectively. With this structure, the agitator 120 is rotatably supported by the developing frame 97. Further, the right and left end parts of the agitator shaft 130 protrude outward from the corresponding side walls 100, respectively. That is, an agitator shaft left end part 130*a*, which is a left end part of the agitator shaft 130, protrudes leftward from the left side wall 100. Further, an agitator shaft right end part 130*b*, which is a right end part of the agitator shaft 130, protrudes rightward from the right side wall 100.

The agitator blade 131 is formed of flexible film material. The agitator blade 131 extend in a radial direction of the agitator shaft 130 from a position of the agitator shaft 130 inside the toner reservoir 110.

The driving unit 200 has a gear cover 190, a developer gear 122*c*, a supplier gear 27*a*, an agitator gear 130*c* and an intermediate gear 140.

The gear cover 190 is secured to the left side surface of the left side wall 100. The gear cover 190 is substantially box-shaped, and extends in the front-and-rear direction. The gear cover 190 covers the developer gear 122*c*, the supplier gear 27*a*, the agitator gear 130*c*, and the intermediate gear 140.

The developer gear 122*c* is secured to the developing roller right end shaft 122*b* so as not to be rotatable relative to the developing roller right end shaft 122*b*.

The supplier gear 27*a* is secured to the right end part of the supplying roller 27 so as not to be rotatable relative to the supplying roller 27. The supplier gear 27*a* is arranged on a front side with respect to the developer gear 122*c* with a space therebetween.

The agitator gear 130*c* is secured to the agitator right end shaft 130*a* so as not to be rotatable relative to the agitator gear 130*c*. The agitator gear 130*c* is arranged on the front side with respect to the supplier gear 27*a* with a space therebetween.

The intermediate gear 140 is secured to the left surface of the gear cover 140 so as to be rotatable relative to the gear cover 140. The intermediate gear 140 is arranged between the supplier gear 27*a* and the agitator gear 130*c*, and engage with both the supplier gear 27*a* and the agitator gear 130*c*.

The waste toner collecting box 96 is accommodated in a box containing part 171 of the drum frame 50. The waste toner collecting box 96 is arranged on a left side with respect to the developing unit 95 so as to face the developing unit 95, and further face the developing unit 95 in the right-and-left direction. The waste toner collecting box 95 is arranged at a lower position in the vertical direction with respect to the blade 83.

The waste toner collecting box 96 has a waste toner collecting part 150 and a connection part 151 (see FIGS. 1, 3 and 9).

The waste toner collecting part 150 is box-shaped having a rectangular side view, and has front guide 154, a rear guide 155 and boss 156.

The front guide 154 is arranged to penetrate through a central part of the waste toner collecting part 150 in the right-and-left direction. The front guide 154 has a first part 154*a* and a second part 154*b*.

The first part 154*a* extends downward from the central part of the waste toner collecting part 150. A width of the first part 154*a* is substantially the same as a diameter of the agitator shaft 130. The first part 154*a* is shaped to overlap the second part 64*b* of the right wall 51R and the second part 85*b* of the partition wall 56 when projected in the right-and-left direction in a state where the waste toner collecting box 86 is attached to the box containing part 171.

The second part 154*b* extends in a upper rear direction from the lower end part of the first part 154*a* as shown in FIGS. 1, 3 and 9. The second part 154*b* is shaped to overlap the third part 64*c* of the right wall 51R and the third part 85*c* of the partition wall 56 when projected in the right-and-left direction in a state where the waste toner collecting box 86 is attached to the box containing part 171.

The rear guide 155 extends in the upper rear direction from the lower rear part of the waste toner collecting part 150 (see FIGS. 1, 3 and 9). A width of the rear guide 155 is substantially the same as a diameter of the developing roller shaft 122. The rear guide 155 has a shape which overlaps the sixth part 65*c* of the right wall 51R and the sixth part 86*c* of the partition wall 56 when projected in the right-and-left direction in a state where the waste toner collecting box 86 is attached to the box containing part 171 (see FIG. 10A).

The boss 156 is arranged at a central position in a lower part of a left side surface of the waste toner collecting part 150. The boss 156 protrudes leftward from the left side surface of the waste toner collecting part 150.

The connecting part 151 is arranged on a rear side with respect to waste toner collecting part 150. The connecting part 151 has a waste toner passage 161 and a box side attaching part 160.

The waste toner passage 161 is a substantially cylindrical tubular member, and extends in an upper rear direction from an upper rear part of the waste toner containing part 150. That is, the waste toner passage 161 is inclined from a lower front position to an upper rear position. The waste toner passage 161 has an inner circumferential surface 161*a*.

An inner circumferential surface 161*a* is an inner circumferential surface of the waste toner passage 161 and has a cylindrical tubular shape. A lower part of the inner circumferential surface 161*a* is formed as an inclined surface which contact the waste toner and guides the same in a lower front direction when the waste toner moved in the lower front direction by its own weight.

The box side attaching part 160 has a curved part 162 and a box side shutter 163.

The curved part 162 is arranged at a rear end part of the waste toner passage 161 such that the curved part 162 close the rear end part of the waste toner passage 161. The curved part 162 has a semicircular cross sectional side view and extends in the right-and-left direction. The curved part 162 is formed to curve so as to substantially overlap a curved part 93 of the drum side attaching part 94 when viewed in the right-and-left direction. The curved part 162 is detachably connected to the curved part 93 of the drum side attaching part 94. At a lower front part of the curved part 162, a box side opening 165 is formed to penetrate the curved part 162 in the front-and-rear direction.

A box side shutter 163 is movably attached to an inner curved surface of the curved part 162. The box side shutter 163 has a shape of curved plate when viewed in the right-and-left direction, and is formed to fit the shape of the curved surface of the curved part 162. As the box side shutter 163 moved along the curved part 162, the box side opening 165 is closed or opened.

The waste toner collecting box 96 and the developing unit 97 are relatively movably connected. Specifically, the agitator left end shaft 130*a* is inserted through the front guide 154 and is movable along the front guide 154. The developing roller left end shaft 122*a* is inserted through the rear guide 155 and movable along the rear guide 155. With this configuration, the developing unit 97 is movable with respect to the waste toner collecting box 96 within a range in which the agitator left end shaft 130*a* can be guided by the front guide 154, and the developing roller left end shaft 122*a* can be guided by the rear guide 155.

Next, attachment/detachment of the developing cartridge 19 to/from the drum cartridge 18 will be described with reference to FIG. 10.

Firstly, a worker grasps the grip 210 and rotate the developing unit 95 clockwise with respect to the waste toner collecting box 96 when viewed from the right side when the developing cartridge 19 is to be attached to the drum cartridge 18.

Then the developing unit 95 rotates with respect to the waste toner collecting box 96 such that the rear end part thereof is directed in the lower rear direction. Then, the agitator left end shaft 130*a* is located within an upper end area of the first part 154*a* of the waste toner collecting box 96. Further, the developing roller left end shaft 122*a* is located within a lower front area of the rear guide 155 of the waste toner collecting box 96.

Next, the worker grasps the grip 210 and inserts the developing unit 95 in the unit attaching part 170 and inserts the waste toner collecting box 96 in the box containing part 171 with the developing unit 95 being rotated with respect to the waste toner collecting box 96.

Then, the boss 156 of the waste toner collecting box 96 is fitted in the left guide 63 of the right wall 51L of the drum cartridge 18. The agitator left end shaft 130*a* is fitted within the first part 85*a* of the partition wall 56, between the waste toner collecting box 96 and the developing unit 95. Further, the agitator right end shaft 130*b* is fitted within the first part 64*a* of the right wall 51R. The developing roller left end shaft 122*a* is fitted within the fourth part 86*a* of the partition wall 56, between the waste toner collecting box 96 and the developing unit 95. The developing roller right end shaft 122*b* is fitted within the fourth part 64*a* of the right wall 51R.

Next, the worker grasps the grip 210 and inserts the developing cartridge 19 in the lower rear direction.

Then, the waste toner collecting box 96 moves in the lower rear direction as the boss 156 is guided by the left guide 63.

The developing unit 95 moves in the lower rear direction with being rotated with respect to the waste toner collecting box 96 as the agitator left end shaft 130*a* is guided by the first part 85*a* of the partition wall 56, the agitator right end shaft 130*b* is guided by the first part 64*a* of the right wall 51R, the developing roller left end shaft 122*a* is guided by the fourth part 86*a* and the fifth part 86*b* of the partition wall 56, and the developing roller right end shaft 122*b* is guided by the fourth part 65*a* and the fifth part 65*b* of the right wall 51R.

Then, the waste toner collecting box 96 is attached to the box containing part 171 and positioned therein as the boss 156 is located at the lower rear part of the left guide 63 as shown in FIG. 10A. At this stage, the first part 154*a* of the waste toner collecting part 150 overlap the second part 64*b* of the right wall 51R in the right-and-left direction, and the second part 154*b* of the waste toner collecting part 150 overlaps the third part 64*c* of the right wall 51R in the right-and-left direction. Further, the rear guide 155 of the waste toner collecting part 150 overlaps the sixth part 65*c* of the right wall 51R.

Further, at this stage, the curved part 162 of the connecting part 151 fitted on an upper front half of the drum side attaching part 94 of the drum frame 50 from outside as shown in FIG. 4. The box side shutter 163 engages with the drum side attaching part 94. That is, the connecting part 151 is configured to be connected to/separated from the drum side attaching part 94.

Further, the developing unit 95 is attached into the unit attaching part 170 in a state where the developing unit 95 is rotated with respect to the waste toner collecting box 96 as the developing roller right end shaft 122*b* is located within the front end part of the sixth part 65*c*. The location of the developing unit 95 at this stage is a detachable position. At this stage, the agitator left end shaft 130*a* is located above the second part 85*b* of the partition wall 56. Further, the agitator right end shaft 130*b* is located above the second part 64*b* of the right wall 51R. The developing roller 26 is slightly separated in the lower front position with respect to the photoconductive drum 20.

Next, the worker grasps the grip 210 and pushes the front end part of the developing unit 95 downward with the developing roller shaft 122 being a center of a rotation.

Then, the developing unit 95 rotates counterclockwise, when viewed from the right side, with respect to the waste toner collecting box 96 about the developing roller shaft 122.

Then, as shown in FIG. 10B, the agitator right end shaft 130*b* is located within a lower end part of the second part 64*b* of the right wall 51R, and the agitator left end shaft 130*a* is arranged within the second part 85*b* and a lower end part of the first part 154*a* of the waste toner collecting part 150. Further, the front end part of the developing unit 95 contacts the engaging part 71 from above. With this configuration, the engaging part 71 rotates counterclockwise, when viewed from the right side, about the lower end part thereof, against the urging force of the spring 72.

Next, the worker grasps the grip 210 and pushes the developing unit in the upper rear direction with using the pressing force of the engaging part 71 to the developing unit 95.

Then, the developing unit 95 moves in the upper rear direction as the agitator left end shaft 130*a* is guided by the third part 85*c*, the agitator right end shaft 130*b* is guided by the third part 64*c* of the right wall 51R, the developing roller left end shaft 122*a* is guided by the sixth part 86*c* of the partition wall 56 and the developing roller left end shaft 122*a* is guided by the sixth part 65*c* of the right wall 51R.

When the rear end part of the developing roller 26 contacts the front end part of the photoconductive drum 20, attachment of the developing unit 95 to the unit attaching part 170 has been completed (FIG. 10C). The position of the developing unit at this stage is the attaching position.

Further, the worker rotates the drum side attaching part 94 so that the drum side opening 98 and the drum shutter opening 99 face each other, after attaching the developing unit 95 to the unit attaching part 170 has completed. Then, in association with the rotation of the drum side attaching part 94, the box side shutter 163 moves upward with respect to the box side opening 165, and the drum side opening 98 and the drum shutter opening 99 communicate with each other.

The developing cartridge 19 can be detached from the drum cartridge 18 by operating the developing cartridge 19 in an opposite way to an operation describe above to attach the developing cartridge 19 to the drum cartridge 18.

Specifically, the worker rotates the drum side attaching part 94 so that the drum shutter opening 99 is shifted downward with respect to the drum side opening 98, and then rotates the developing unit 95 clockwise when viewed from the right, thereby moving the developing unit 95 from the attached position shown in FIG. 10C to the detachable position shown in FIG. 10A.

Thereafter, the worker grasps the grip 210 and pull the developing cartridge 19 upward to remove the same from the drum cartridge 18.

Next, attachment of the process cartridge 15 to the casing 2 will be described referring to FIG. 11.

In order to attach the process cartridge 15 to the casing, the worker rotates the flatbed scanner 6 counterclockwise when viewed from the left side and move the top cover 79 from the close position to the open position.

Next, the worker inserts the process cartridge 15 in the casing 2 along the lower rear direction. At this stage, the protrusions 146 are located above the introducing part 144 of the cover guide 140.

Next, the worker pushes the process cartridge 15 in the lower rear direction. Then, the protrusions 146 reaches positions above the first cover guide 142 from the introduction part 144, via the second cover guide 143. Then, the drum cartridge 18 moves in the lower rear direction.

When the process cartridge 15 is further moved in the lower rear direction, the protrusions 146 reaches the corresponding engaging parts 141 and fitted therein, and the rear end parts of the protrusions 146 contact the regulation part 78.

Next, the worker moves the top cover 79 from the open position to the close position, and rotates the flatbed scanner 6 clockwise when viewed from the left side.

At this stage, the protrusions 146 move in the lower rear direction in association with the movement of the top cover 79. Then, the process cartridge 15 moved in the lower rear direction, and attached inside the casing 2 as shown in FIG. 1.

As above, the attaching movement of the process cartridge 15 to attach the casing 2 has been completed.

When the worker detaches the process cartridge 15 from the casing, an operation opposite to the attaching operation described above is to be made.

Specifically, the worker rotates the flatbed scanner 6 counterclockwise when viewed in the left side, and moves the top cover 79 from the close position to the open position. It is noted that the movement of the top cover 79 between the close position and the open position may be made to associate the rotational movement of the flatbed scanner 6 with use of a well-known association mechanism.

It is noted that the protrusions 146 are fitted in the engagement part 141. Therefore, the protrusions 146 move upward in association with the movement of the top cover 79 from the close position to the open position. Then, the front end part of the process cartridge 15 moves upward as if it rotates counterclockwise, when viewed from the left side, about the rear end part.

With this movement, the upper front end part of the process cartridge 15 is located at a position outside the casing 2, via the process opening 196.

Next, the worker draws the process cartridge 15 in the upper front direction.

Then, the protrusions 146 moves in the upper front direction and are detached from the engaging parts 141 of the guide body 149, and moves to positions on the first cover guide 142. Then, the first cover guide 142 guides the movement of the protrusions 146. With this configuration, the process cartridge 15 moves in the upper front direction.

Next, the worker further draws the process cartridge 15 in the upper front direction, the protrusions 146 move in the upper front direction, and moves from positions on the first cover guide 142 to positions on the second cover guide 143. At this stage, the second cover guide 143 guides the movement of the protrusions 146.

With the above configuration, the process cartridge 15 is further guided in the upper front direction.

Next, when the worker further draws the process cartridge frontward, the protrusions 146 move front ward, move positions on the second cover guide 143 to positions on the introducing part 144, and detached from the cover guide 140.

With the above movement, the process cartridge 15 moves forward and is detached from the casing 2.

Next, the worker move the top cover 79 from the open position to the close position, and rotates the flatbed scanner 6 clockwise, when viewed from the left side, until the flatbed scanner 6 contacts the scanner supporting wall 195.

With the above operations, the detaching operation of the process cartridge 15 from the casing 2 has been completed.

Next, cleaning of the photoconductive drum 20 when the image is being formed will be described.

In the image forming operation described above, after the toner image on the surface of the photoconductive drum 20 is transferred on the sheet P, toner (i.e., developing agent) may remain on the surface of the photoconductive drum 20.

Such remained toner on the surface of the photoconductive drum 20 may be de-electrified (i.e., discharged) with the film 84 as the photoconductive drum 20 rotates, and then scraped by the blade 83 and collected inside the screw containing part 80.

The remained toner scraped and collected inside the screw containing part 80 is transferred leftward by the screw 90, and enter the waste toner passage 161 by its own weight via the curved part 93 including the drum side opening 98, the drum shutter opening 99 and the box side opening 165.

The waste toner entered the waste toner passage 161 is guided to the inner circumferential surface 161*a* of the waste toner passage 161 inclined in the lower front direction. The toner moves in the lower front direction, by its own weight, in the waste toner passage 161 and collected in the waste toner collecting part 150.

According to the process cartridge 15 described above, the waste toner collecting box 96 is located on the left side with respect to the developing unit 95, and faces the developing unit 95.

Therefore, with a relatively simple structure, the waste toner can be transferred to the waste toner collecting box 96, and downsizing of the passage of the waste toner can be achieved.

Further, the developing unit 95 can be connected to the waste toner collecting box 96 so as to be movable in a direction connecting a lower front position and an upper rear position.

Therefore, it is ensured that the waste toner can be transferred, and it is possible to remain the developing roller 26 at an appropriate position with respect to the photoconductive drum 20.

Further, as shown in FIG. 5, the screw 90 is configured to convey the waste toner collected by the blade 93 leftward, and the waste toner collecting box 96 is provided with a connecting part 151 with which the waste toner collecting box 96 is connected to the drum side attaching part 94.

Accordingly, by connecting the waste toner collecting box 96 with the drum side attaching part 94 with use of the connecting part 151, and by conveying the waste toner leftward with the screw 90, the waste toner can be collected in the waste toner collecting box 96.

As a result, with a relatively simple structure, the waste toner can be conveyed and downsizing of the apparatus can be achieved.

Further, the connecting part 15 is configured to be connected to or separated from the drum side attaching part 94.

Therefore, by connecting/separating the connecting part 15 to/from the drums side attaching part 94, the waste toner collecting box 96 can be attached to/detached from the drum cartridge 15.

Further, as shown in FIG. 3, the developing roller right end shaft 122*b* is positioned with the rear guide 65 provided to the right wall 51R and the developing roller left end shaft 122*a* is positioned with the rear guide 86 provided to the partition wall 56.

Therefore, in a structure where the waste toner collecting box 96 faces the developing unit from the left side, both end parts of the developing unit 95 can be securely positioned, and therefore, image formation can be performed in a stabled state.

Further, as shown in FIG. 3, the waste toner collecting box 96 is guided by the left guide 63 provided to the left wall 51L, and fixed.

Therefore, it is ensured that the waste toner collecting box 96 is attached to the drum cartridge 15.

Figure 7C:
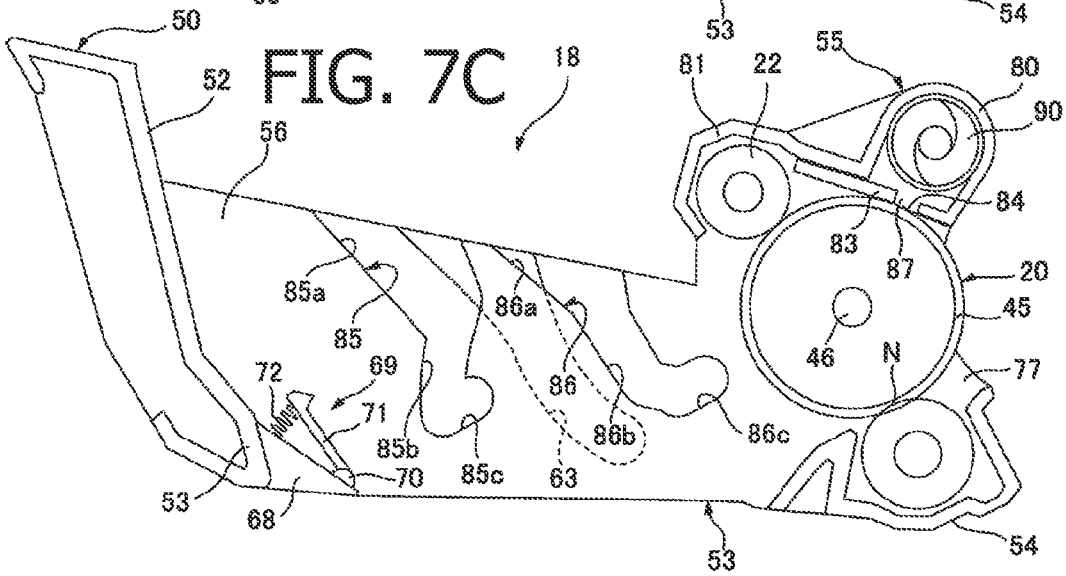
FIG. 7C is a cross-sectional view of the drum cartridge show in FIG. 4 taken along line C-C of FIG. 4.

Furthermore, as shown in FIG. 7C, the front guide 64 has the first guide part which guides the developing unit 95 in a direction connecting an upper front position and a lower rear position, which is a direction of attaching/detaching the developing unit 95.

Therefore, a detaching/attaching direction of the developing unit 95 and the detaching/attaching direction of the waste toner collecting box 96 with respect to the drum cartridge 18 are made to be the same direction.

As a result, the developing unit 96 and the waste toner collecting box 96 can easily be detached from/attached to the drum cartridge 18.

The front guide 64 has the first part 64*a* which guides the developing unit 95 in a direction connecting the upper front position and the lower rear position, which direction is the attaching/detaching direction of the developing unit 95, and the third part 64*c* which guides the developing unit 95 located at the attached position in a direction connecting the lower front position and the upper rear position. Further, the rear guide 65 has the first part 65*a* guiding the developing unit in a direction connecting the upper front position and the lower rear position, which direction is the attaching/detaching direction of the developing unit 95, and the third part 65*c* which guides the developing unit 95 located at the attached position in a direction connecting the lower front position and the upper rear position.

Therefore, it is possible to move the developing unit 95 in a direction connecting the lower front position and the upper rear position when the developing unit 95 is located at the attached position, with the attaching/detaching direction of the developing unit 95 being defined in a direction connecting the upper front position and the lower rear position.

As a result, it is ensured to make the developing roller 26 contact and follow the rotation of the photoconductive drum 20.

Further, as shown in FIG. 10B, the urging member 69 is provided to urge the developing unit 95 toward the photoconductive drum 20.

Therefore, by the urging force, it becomes possible to make the developing roller 26 elastically contact the photoconductive drum 20.

As a result, it is ensured to make the developing roller 26 contact the photoconductive drum 20.

Further, as shown in FIG. 1, the blade 83 is located at a higher position, in the vertical direction, with respect to the photoconductive drum 20, and the waste toner collecting box 96 is located at a lower position, in the vertical direction, with respect to the blade 83.

According to such a configuration, the waste toner collecting box 96 is arranged below the blade 83.

Therefore, the waste toner removed by the blade 83 can be collected in the waste toner collecting box 96 making use of the gravity.

As a result, the structure of the blade 83 and the waste toner collecting box 96 can be simplified.

Further, as shown in FIG. 1, since the developing unit 95 is provide with a grip, the attaching/detaching operation of the developing unit 95 can be performed relatively easily.

Hereinafter, referring to FIGS. 12-15, a modification of the process cartridge will be described. In the following description, members same as those in the above-described illustrative embodiment will be assigned with the same reference numbers, and detailed description will not be repeated for brevity.

In the above-described illustrative embodiment, the drum cartridge 18 has a partition wall 56 which partitions the unit attaching part 170 from the box containing part 171. Further, the developing roller left end shaft 122*a* and the agitator left end shaft 130*a* are positioned with respect to the drum cartridge 18 by the rear guide 86 and the front guide 85, respectively.

In contrast, according to the modification shown in FIG. 12, the drum cartridge 18 is not provided with the partition wall 56. As shown in FIG. 15, the developing roller left end shaft 122*a* and the agitator left end shaft 130*a* are positioned with respect to the drum cart 18 by a rear guide 155 and a front guide 154 of the waste toner collecting box 96, respectively.

Specifically, as shown in FIG. 13, the waste toner collecting box 96 has a recess part 207.

The recessed part 207 is arranged at a rear end part of the waste toner collecting part 150 of the waste toner collecting box 96. The recessed part 207 is U-shaped when viewed in the right-and-left direction such that the recessed part 207 is recessed in an upper front direction from the rear end of the waste toner collecting part 150 and the lower rear end part is exposed to outside. The recessed part 207 is provided to an extended part, which is an extension of the right side wall of the waste toner collecting box 96.

When the developing cartridge 19 has been attached to the drum cartridge 18, the recessed par 207 is fitted on the drum shaft 46 located inside the box containing part 171 (see FIGS. 14 and 15). With this configuration, the waste toner collecting box 96 is positioned with respect to the drum cartridge 18.

Further, the developing roller left end shaft 122*a* and the agitator left end shaft 130*a* respectively engage with the waste toner collecting box 96, which is positioned with respect to the drum cartridge 18, via the rear guide 155 and the front guide 154 of the waste toner collecting box 96.

As above, the developing cartridge 19 is positioned with respect to the drum cartridge 18 via the waste toner collecting box 96.

According to the modification described above, the developing roller left end shaft 122*a* engages with the rear guide 155 provided to the waste toner collecting box 96, and the developing roller right end shaft 122*b* is positioned by the rear guide 65 provided to the right wall 51R (FIG. 14).

Accordingly, in a structure where the waste toner collecting box 96 faces the developing unit 97 from the left side, it is ensured that the developing unit 97 is securely attached to the drum cartridge 18.

In this structure, since the developing unit 97 is attached with use of the waste toner collecting box 96, the number of members can be reduced.

What is claimed is:

1. An image forming apparatus comprising:

a casing comprising a front wall and a rear wall spaced apart from the front wall in a front-rear direction;

a scanner configured to emit a laser beam and arranged closer to the front wall than to the rear wall; and a process cartridge detachably attachable to the casing, the process cartridge comprising:

a developing roller;

a photoconductive drum exposed by the laser beam from the scanner and arranged closer to the rear wall than to the front wall when the process cartridge is attached to the casing;

a cleaner configured to remove waste toner from the photoconductive drum and arranged above the photoconductive drum;

a connecting part configured to pass the waste toner removed by the cleaner therethrough, the connecting part extending in a direction from the rear wall to the front wall when the process cartridge is attached to the casing and arranged outside the developing roller in a direction in which an axis of the developing roller extends; and a collecting part configured to store the waste toner from the connecting part, the collecting part arranged between the scanner and the photoconductive drum in the front-rear direction when the process cartridge is attached to the casing.

2. The image forming apparatus according to claim 1, wherein the connecting part is inclined from a lower front position to an upper rear position.

3. The image forming apparatus according to claim 1, wherein the process cartridge further comprises a screw configured to convey the waste toner removed by the cleaner in the direction in which the axis of the developing roller extends.

4. The image forming apparatus according to claim 1, wherein the process cartridge comprises a grip.

5. The image forming apparatus according to claim 4, wherein the grip has a through hole through which the laser beam emitted from the scanner towards the photoconductive drum passes.

6. The image forming apparatus according to claim 1, wherein the collecting part is arranged outside the developing roller in the direction in which the axis of the developing roller extends.

7. The image forming apparatus according to claim 1, wherein the process cartridge comprises a developing cartridge and a drum cartridge, the developing cartridge comprising the developing roller, and the drum cartridge comprising the photoconductive drum, wherein the developing cartridge is detachably attached to the drum cartridge.

8. The image forming apparatus according to claim 1, wherein the developing roller is movable with respect to the photoconductive drum between:

a first position where the developing roller comes close to the photoconductive drum for supplying toner onto a circumferential surface of the photoconductive drum, and a second position where the developing roller moves away from the photoconductive drum.

* * * * *